US005487737A

United States Patent [19]

Meyer

[11] Patent Number: 5,487,737

[45] Date of Patent: Jan. 30, 1996

[54] STORAGE AND TRANSFER BOTTLE DESIGNED FOR STORING A COMPONENT OF A MEDICAMENTAL SUBSTANCE

[75] Inventor: Gabriel Meyer, Vesenaz, Switzerland

[73] Assignee: Becton, Dickinson and Company, Franklin Lakes, N.J.

[21] Appl. No.: 138,878

[22] Filed: Oct. 18, 1993

Related U.S. Application Data

[63] Continuation of Ser. No. 566,423, Aug. 29, 1990, abandoned.

[30] Foreign Application Priority Data

Dec. 27, 1988 [CH] Switzerland ..... 4805/88
Oct. 30, 1989 [CH] Switzerland ..... 3919/89

[51] Int. Cl.[6] ..... A61J 1/00

[52] U.S. Cl. ..... 604/403; 604/411; 604/416

[58] Field of Search ..... 604/403, 404, 604/405, 406, 408, 410, 411, 412, 413, 414, 415, 416

[56] References Cited

U.S. PATENT DOCUMENTS 2,813,649 11/1957 Lipari .
2,908,274 10/1959 Bajan .
3,206,073 9/1965 Scislowicz ..... 604/414 X
3,206,080 9/1965 Scislowicz .
3,563,415 2/1971 Ogle .
3,674,028 7/1972 Ogle .
4,261,474 4/1981 Cohen ..... 604/406 X
4,265,242 5/1981 Cohen ..... 604/406
4,294,250 10/1981 Dennehey ..... 604/403
4,591,357 5/1986 Sneider ..... 604/410 X
4,657,534 4/1987 Beck .
4,822,351 4/1989 Purcell ..... 604/411
5,035,689 7/1991 Schroeder ..... 604/414 X

FOREIGN PATENT DOCUMENTS 1071487 9/1954 France .
1487413 5/1966 France ..... 604/411
2111029 6/1983 United Kingdom .

*Primary Examiner*—Sam Rimell
*Attorney, Agent, or Firm*—Vincent A. Castiglione

[57] ABSTRACT

The bottle (10) comprises a stopper means (153) engaged in the neck and mounted on a capsule (150) situated above the neck. The capsule (150) is integral with a conical connecting tip allowing a Luer-Lock type connection to be made. The entire unit is protected by a cap (151). The stopper means ( 153) is made of two parts, a head (154) and an annular gasket (155) which may be of different materials. A tamper-proof label connects the bottle (10) to the cap (151).

21 Claims, 29 Drawing Sheets

STORAGE AND TRANSFER BOTTLE DESIGNED FOR STORING A COMPONENT OF A MEDICAMENTAL SUBSTANCE

This is a continuation of application Ser. No. 07/566,423 filed on Aug. 9, 1990 abandoned.

The present invention concerns a single compartment storage and transfer bottle designed for storing a component of a medicinal substance and transferring it directly, or after mixing it with another substance, into a utility device, said bottle comprising an open conical neck and a stopper device cheated in said neck.

Medicinal substances, whether directly usable or components of a mixture, are usually stored in receptacles which are either flame sealed ampoules or bottles sealed with a stopper.

A bottle of this type is described, for example, in U.S. Pat. No. 3,674,028 and comprises a body with a tapered neck and a central constriction defining two compartments respectively containing a lyophilisate and a solvent to be mixed. The neck is sealed by a special stopper allowing vapors from lyophilization of the substance in the lower compartment to escape. After lyophilization the stopper is pushed into the central zone of the body comprising the restriction and thus totally separates the two compartments. A stopper is placed at the end of the neck to close the upper compartment after it has been filled. This stopper comprises a narrower central zone to be traversed by a needle so the mixture may be removed for injection into a patient.

The bottles and ampoules for holding liquid medicinal substances known in the art both pose a considerable problem when their contents are transferred into a utility device such as a syringe. In practice, medical personnel must use a needle to aspirate the liquid from the bottle each time. Now, the needle used to effect the transfer acquires contaminated outer surfaces from the medicinal substance. This external needle contamination is responsible for discomfort, hematomas and other tissue lesions, since, in theory, tissue should not be in contact with medicinal substances. Furthermore, the transfer process cannot avoid causing bacterial and particle contamination. For reasons of hygiene, there is a rule of not re-using the transfer needle and replacing it with a new sterile needle for each transfer operation.

However, there is no guarantee that medical personnel will respect this rule. Because of this, there is a real danger to the patient, especially when the transfer needle is also used for the injection. Contact between tissue and the medicinal substance, contaminants, bacteria and particles transported by the needle is thus inevitable.

The problem is essentially the same when the substance is in a bottle, with the additional known difficulties of puncturing the stopper.

Among systems currently in commercial use there figures a device called the "Transfer Set" comprising a double needle or double trocar, used for direct connection between a bottle sealed with an elastomeric stopper and a transfusion bottle or pouch. The bottle may contain liquid or dry medicinal substance. The transfer device is always furnished independently of the bottle to which it is supposed to be connected and is in a sterile package. Because of this, nothing prevents it from being re-used on another bottle after the first use, even if hospital hygiene regulations forbid such re-use.

The relatively high cost of this unit increases the tendency toward re-use.

The only way to simultaneously prevent errors in manipulation during the positioning of a transfer device and its re-use is to provide a bottle having a non-removable transfer device.

In order for a transfer system to conform to all security requirements, it is indispensable that it be inviolable, incapable of activation during storage, integral with the bottle, resistant to radial constraint, sterile, and that it guaranty sterility inside the bottle and all its channels, interior cavities and openings for communication between said space with another space defined by another receptacle for holding another component to be mixed with the substance in the bottle.

The present invention proposes to overcome the foregoing disadvantages by realizing a storage bottle which may be connected to all kinds of receptacles or commercial containers, without significantly increasing manufacturing cost and without technical complications.

To achieve this goal, the bottle according to the invention is characterized in that the stopper device is designed for displacement between a first position, called the storage position, in which it comprises an impermeable stopper, and a second position, called the usage position, in which it constitutes an open valve for evacuation of the said medicinal substance, and in that said device is integral with a device connecting the bottle to a receptacle containing another component of the medicinal substance and/or with the utility device.

According to a preferred embodiment, the stopper device may comprise a flexible elastomeric stopper means with a central cavity and a radial canal opening into the central cavity, it may be mounted on a capsule adapted to the bottle neck and axially movable between the said storage position and the said utility position.

The capsule is preferably provided with a conical connecting tip and a tightening element engaged inside a cavity in the stopper means.

The connecting tip may be a "Luer-type" tip or may be a "Luer Lock" tip.

According to other embodiments, the connecting tip is a conical male tip or a conical female tip.

According to an advantageous embodiment, the connecting tip holds a needle and the capsule is provided with a generally cylindrical protective element approximately as long as the needle.

According to one variation, the bottle comprises connection means for flexible connection to the utility device or to another receptacle containing another component of the medicinal substance.

The said connection means preferably comprises a lace which has ends with locking connectors.

The bottle advantageously comprises at least one filter within the connection device or the stopper device, in an area through which the medicinal substance or mixture of this substance and another substance must pass before use. This filter is preferably a membrane type filter.

When the said device is in its first position known as the storage position, the stopper device may be joined to the bottle by a tamper-proof seal or label.

According to an advantageous embodiment, the device comprises a needle disposed to puncture a stopper on an empty or pre-filled receptacle.

Preferably, the said needle comprises at least one lateral opening disposed to release pressure inside the bottle and/or another container connected to the bottle by the said needle.

The stopper device may comprise a vent hole and an elastic stopper element disposed to close said vent in a first position and to free it in a second position.

Advantageously, the said vent hole is situated in a wall of the capsule and the stopper device has a hydroponic filter disposed above the said vent.

Preferably, said hydroponic filter is annular and comprises a central opening for communication between the stopper device and the connection means.

According to an advantageous embodiment, the stopper device is composed of two distinct portions, a head and an annular gasket. The head and the annular gasket are preferably made of different materials.

The invention will be better understood with reference to the description of exemplary embodiments and to the attached drawing, wherein.

Figure 1:
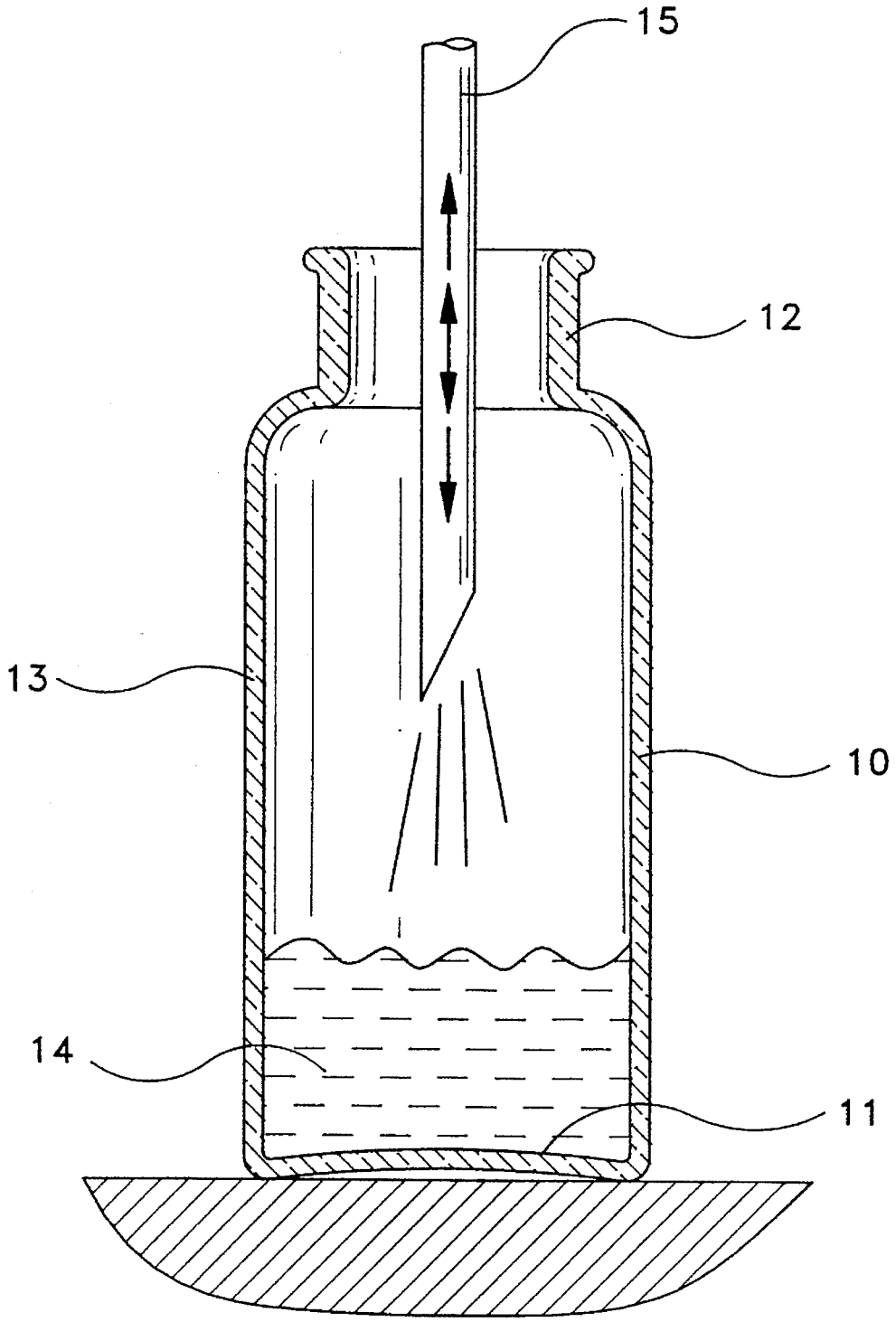
FIGS. 1 through 5 illustrate the process of filling a bottle containing a component in the lyophilized state.

With reference to FIG. 1, a bottle 10 with a closed base 11 and an open neck 12 tapered with respect to bottle body 13 is partially filled with a liquid substance 14 introduced into the bottle through conduit 15. In this case liquid 14 is an aqueous solution of a medicinal substance for lyophilization.

Figure 2:
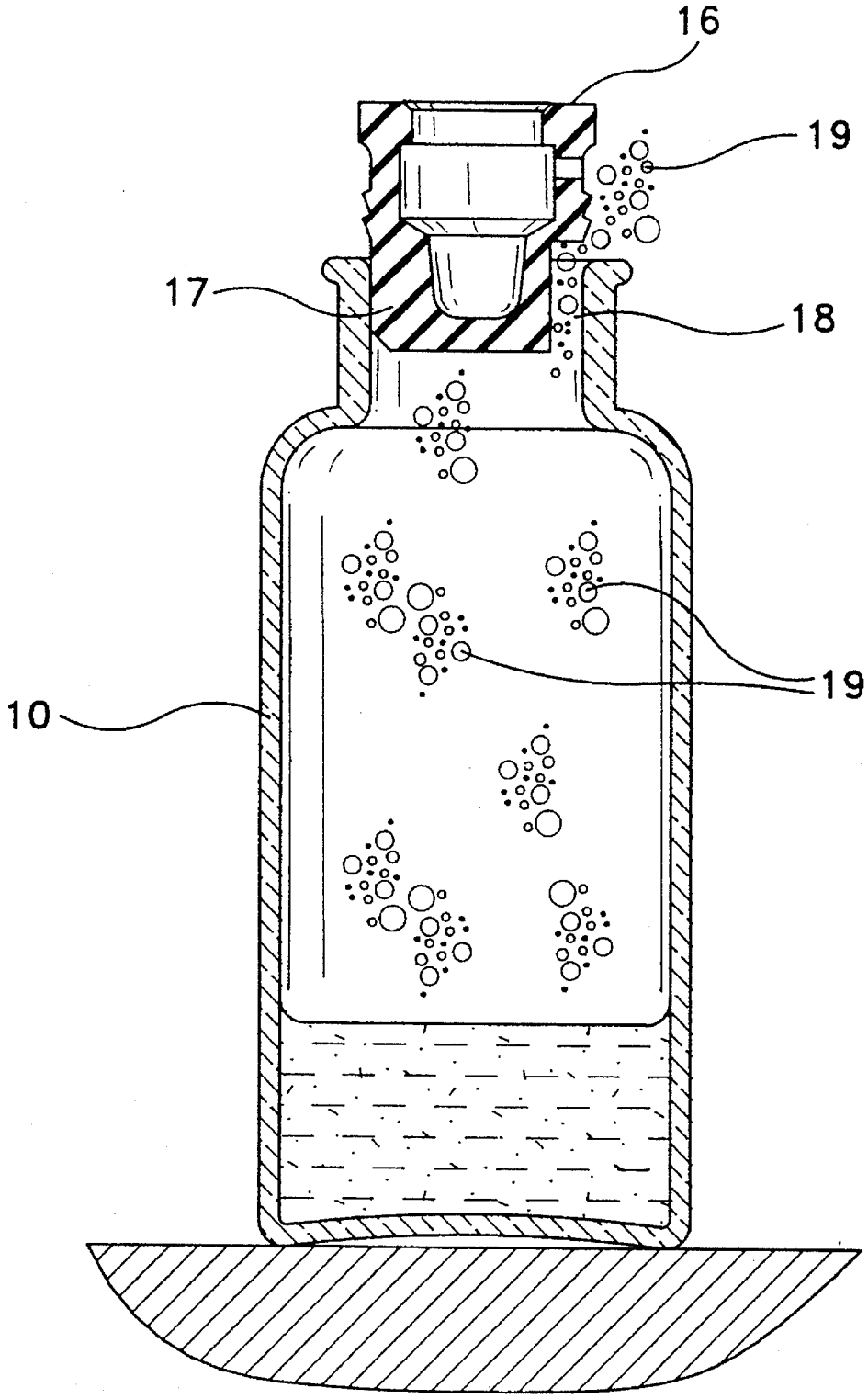

The lyophilization phase is represented in FIG. 2. This operation takes place inside an apparatus essentially comprising a chamber connected to a vacuum pump and cryogenation means. Before penetrating this chamber, bottle 10 is provided with a flexible elastomeric stopper device 16 with a tip 17 at its lower end, integral with the upper part of the stopper means and having at least one lateral opening 18 for water vapor 19 to escape from the bottle. Note that this entire operation takes place under sterile conditions and the bottle is sterile when filled, the stopper means is sterile when positioned on the bottle neck and the lyophilization chamber is a sterile chamber.

Figure 3:
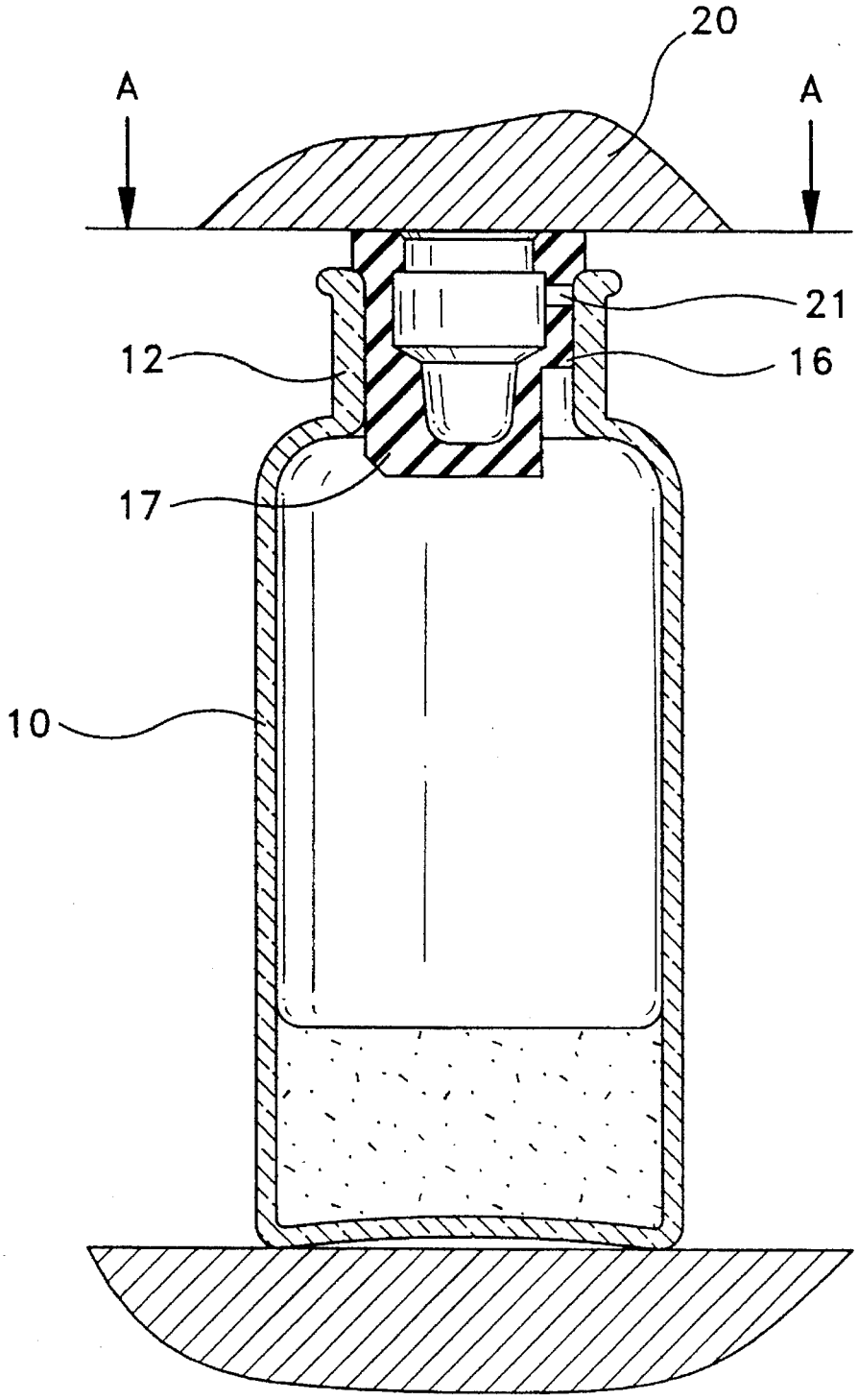

The next phase consists of placing the stopper device in the storage position and is shown in FIG. 3. Moving the stopper means 16 from its lyophilization position shown in FIG. 2 to its storage position shown in FIG. 3 is accomplished by pushing it, as shown by arrows A, with a button 20 inside the lyophilization chamber. Stopper means 16 has a radial canal 21 blocked by the wall of the bottle neck in the position shown in this drawing. In practice, this button comprises the ceiling of the lyophilization chamber. According to other embodiments, the ceiling of the lyophilization chamber is fixed and it is the supporting base of the bottles which moves upward to cause the stopper means to penetrate the interior of the bottle.

Figure 4:
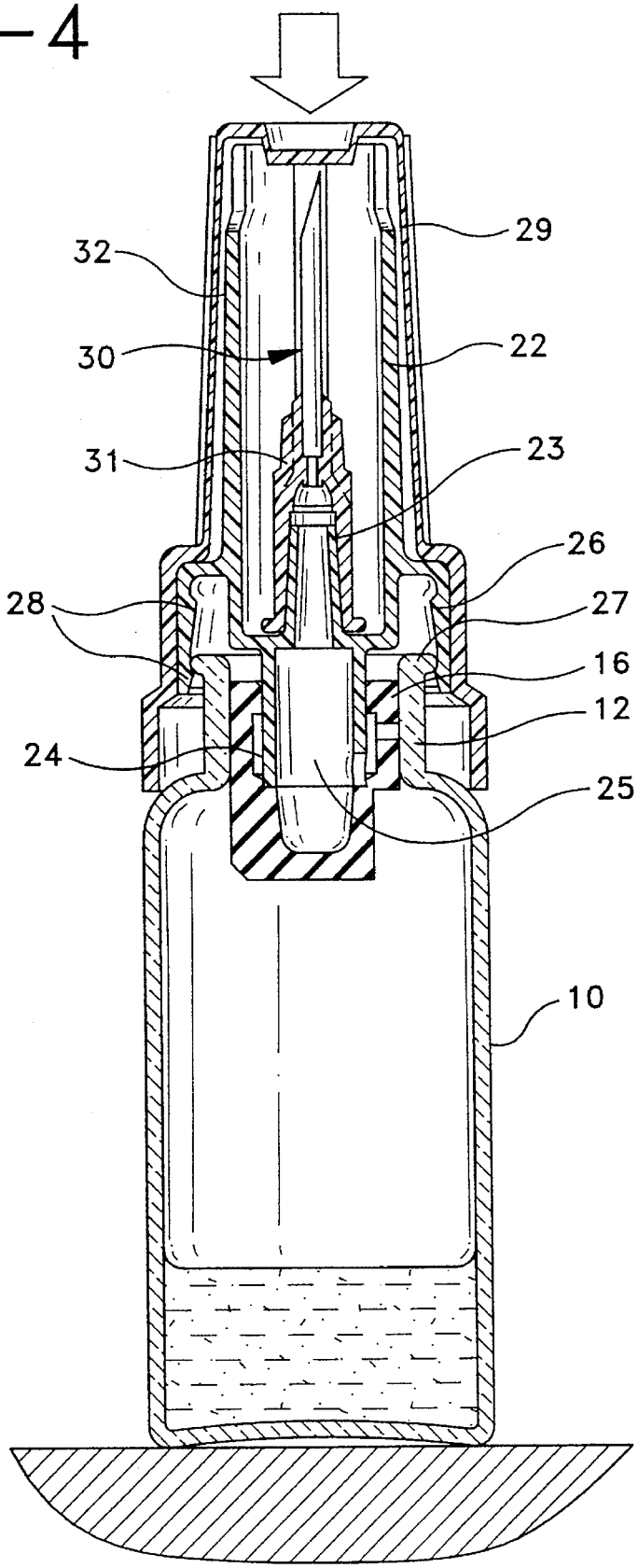

As is shown in FIG. 4, in storage position, tip 17 is engaged inside the bottle and the upper portion of the stopper means is engaged inside neck 12 so that a radial canal 21, disposed in the upper portion of the stopper means, is sealed by the interior wall of neck 12. In this position, the stopper means assumes one of its functions, that of tightly sealing bottle 10 during storage.

Next, the bottle with the lyophilized medicinal substance inside is impermeably sealed by stopper means 16, removed from the lyophilization chamber and provided with a capsule 22 which, along with stopper means 16, constitutes a bottle sealing device and serves as a support for a transfer mechanism which connects bottle 10 with the utility device (not shown). Capsule 22 comprises a connecting tip 23, conical in shape, constituting a "Luer" type tip. This tip extends toward the inside of the bottle through a tightening element 24, generally cylindrical, and engaged inside an interior cavity 25 of stopper means 16. Capsule 22 further comprises a small peripheral flange 26 above rim 27 of neck 12 of bottle 10, which has interior projections 28 for cooperating with rim 27 to define on the one hand, the storage position, and on the other hand, the usage position for the transfer mechanism and consequently for stopper means 16.

The transfer mechanism proper is covered, during the storage phase, with a hooded cap 29 adapted to the size and shape of the different capsule components and particularly of flange 26. In the example shown, connecting tip 23 is associated with a conventional needle 30 soldered to the flange in known manner and with a needle-holding tip 31 which is a conical female tip complementary in shape and size to connecting tip 23. To protect this needle, capsule 22 is extended by a generally cylindrical structure 32 on the side opposite the bottle, which structure is approximately equal in length to the needle and the needle holder.

Figure 5:
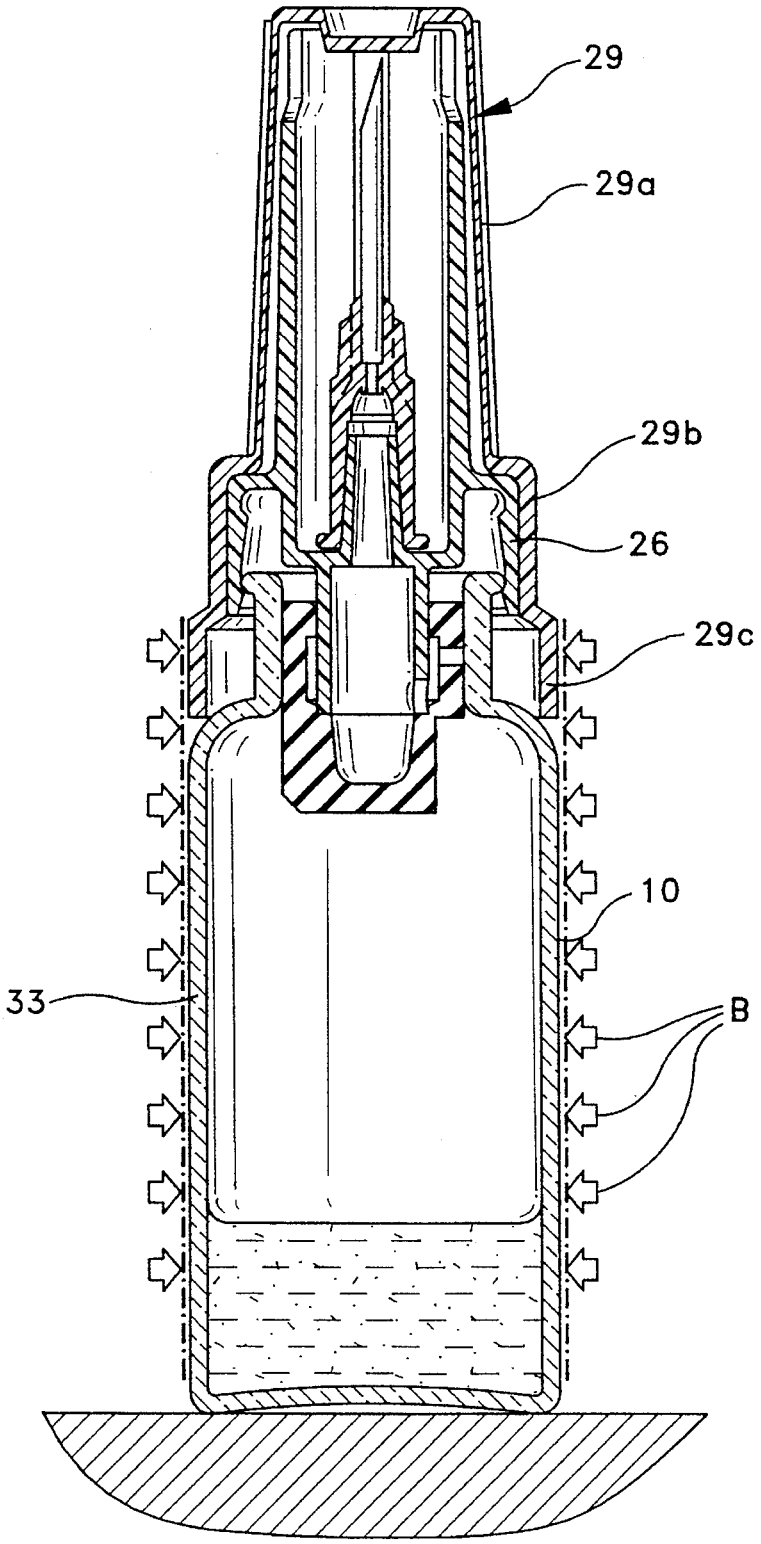

As has been stated, cap 29 surrounds the level of the bottle neck and the capsule flange. For this purpose, as shown in FIG. 5, it has a first tapered portion **29*a* generally surrounding capsule structure 32, an intermediary portion 29*b* in contact with the exterior wall of flange 26 and a rim 29*c* with an exterior diameter essentially equal to the exterior diameter of bottle 10. This formation allows a tamper-proof seal 33 to be placed thereon, which, of course, not only identifies the product, but also holds cover 29 on bottle 10**. Arrows B schematically represent the phase of positioning the tamper-proof seal.

The bottle described above and the filling and assembly phases shown in FIGS. 1 through 5 correspond to use of a medicinal substance which is first in a liquid solution state and destined to be kept in the lyophilized state. For use, the lyophilisate must be rehydrated to transform it into a solution for either direct use or for mixing with another substance. Before such use, a liquid solvent must be introduced into the bottle through the transfer device and more specifically, through the needle in this device. To do this, the tamper-proof seal is torn off, the protective cap removed and the capsule pulled over the neck, thereby causing the upper portion of the stopper means to penetrate the inside of the bottle down as far as the location where lateral opening 21 in the upper portion of the stopper means opens into the inside of the bottle, permitting the needle to communicate with the inside of the bottle. Connection with another sterile chamber takes place through needle 30. According to an advantageous embodiment, the sterile chamber containing solvent is a flexible pouch or other appropriate receptacle.

Because of this type of Luer cone connection, the bottle described may be connected to any commercial device having the same normal Luer-type or Luer Lock connection corresponding to a conical connection with a locking system, specifically: an empty syringe, a pre-filled syringe, a valve for connection to another receptacle or to a conduit, a tube, a peristaltic pump, an inhalator, a flexible transfusion pouch or a collapsible flexible bottle for ocular use.

Figure 6:
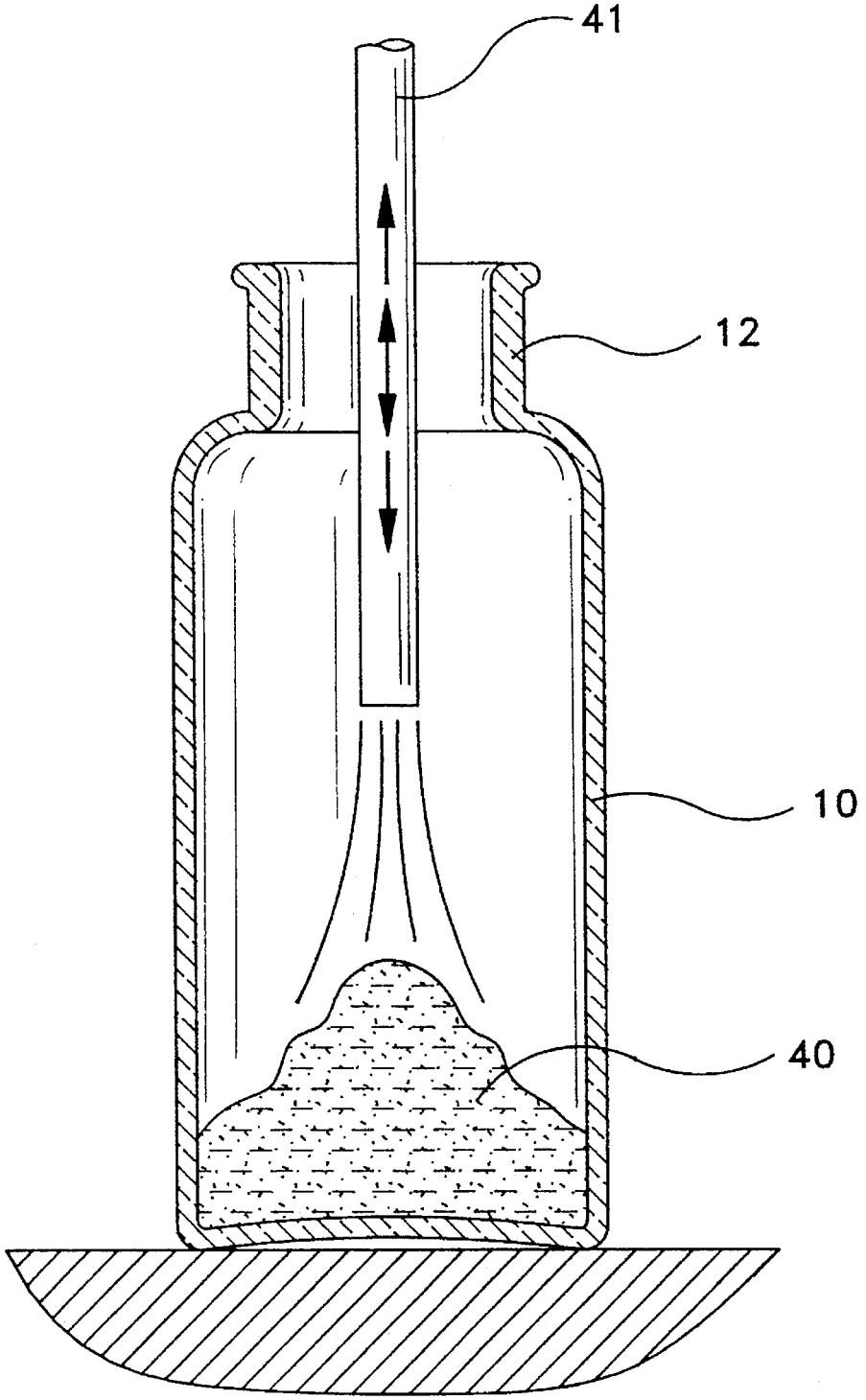
FIGS. 6 through 9 illustrate the process of filling a bottle containing a powder to be mixed with a liquid solvent.

For some uses the medicinal substance to be stored in the bottle is powdered. With a few modifications, the steps of filling for storage and of use are essentially the same as described with reference to FIGS. 1 through 5. FIG. 6 shows a bottle 10 designed for storage of a powder 40 introduced into the bottle through an inlet tube 41. It should be noted that bottle 10 shown in FIG. 6 is identical in all respects to bottle 10 shown by FIG. 1 and the following drawings.

Figure 7:
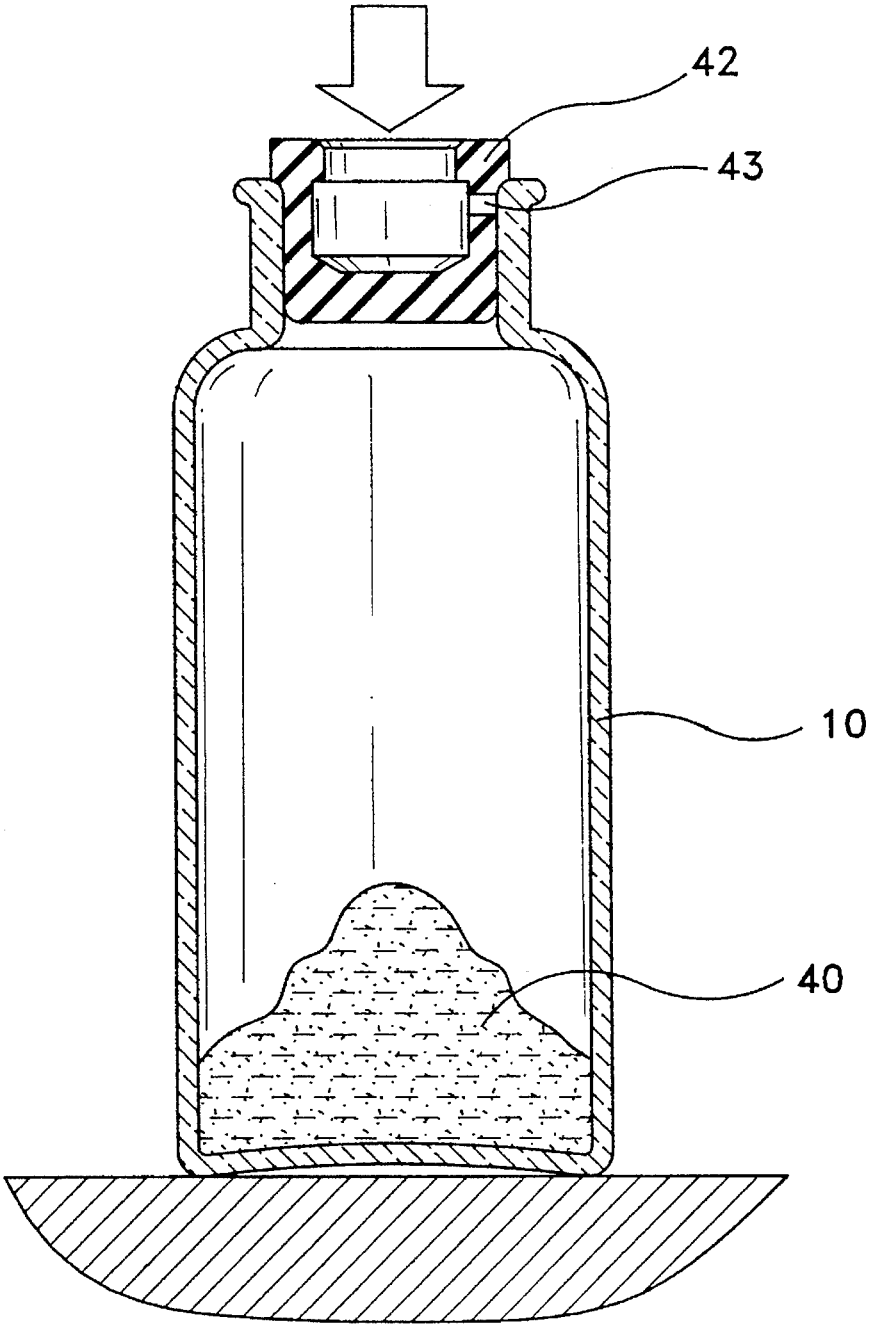

When the correct amount of powder has been introduced into the bottle, the next phase consists of closing the bottle with a stopper means 42 shown in FIG. 7. This stopper means differs from that shown in FIGS. 2 through 5 in that it does not have lower tip 17, which functions strictly during the lyophilization phase. However, this stopper means also comprises a radial conduit 43 for communication with the inside of bottle 10 during use.

Figure 8:
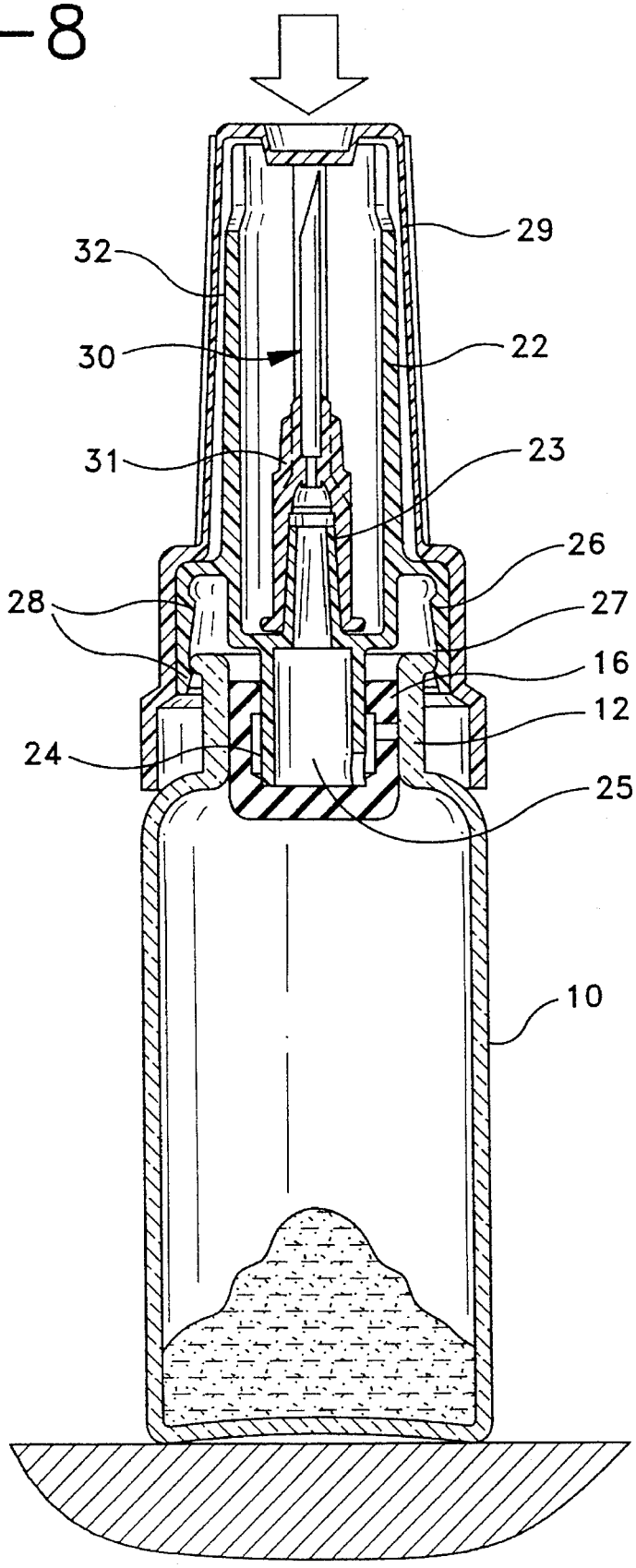

The phase shown in FIG. 8 corresponding to the positioning of the stopper elements and the transfer elements is identical in all respects to that shown in FIG. 4, except for the fact that in one case, the bottle contents is a powder, and in the other, it is a lyophilisate. For this reason the reference numerals for the different components are the same in both cases.

Figure 9:
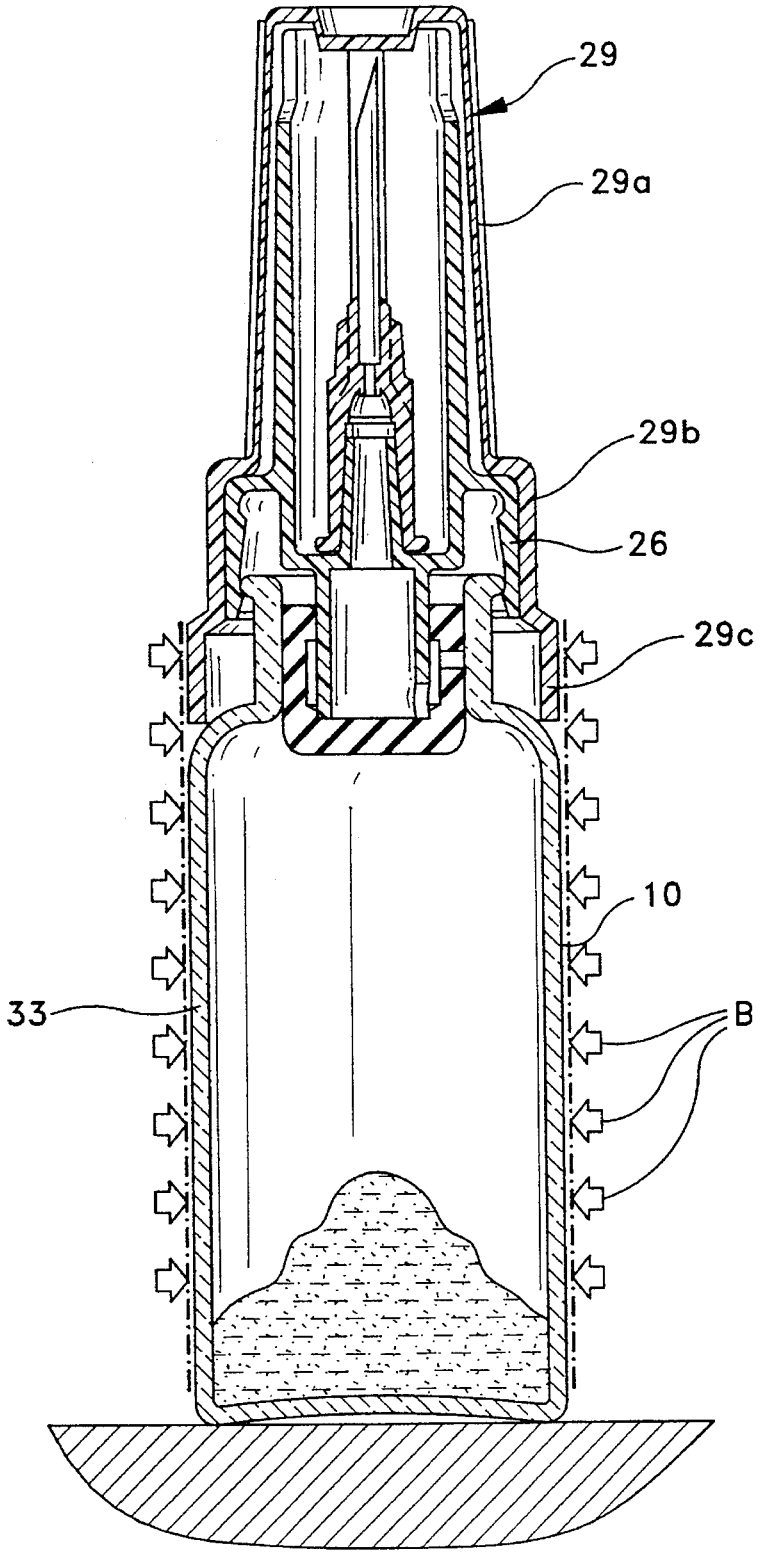

FIG. 9, illustrating the phase of positioning the tamper-proof seal, is identical to FIG. 5 with the same difference as before. For this reason, the reference numerals on the two drawings are identical.

Insofar as the use of the bottles in FIGS. 6 through 9 is concerned, it is essentially identical to that of the preceding bottle. The syringe needle, which is mounted on the connecting tip of the connection device, allows penetration of a solvent for dissolving the powder in the bottle.

Figure 10:
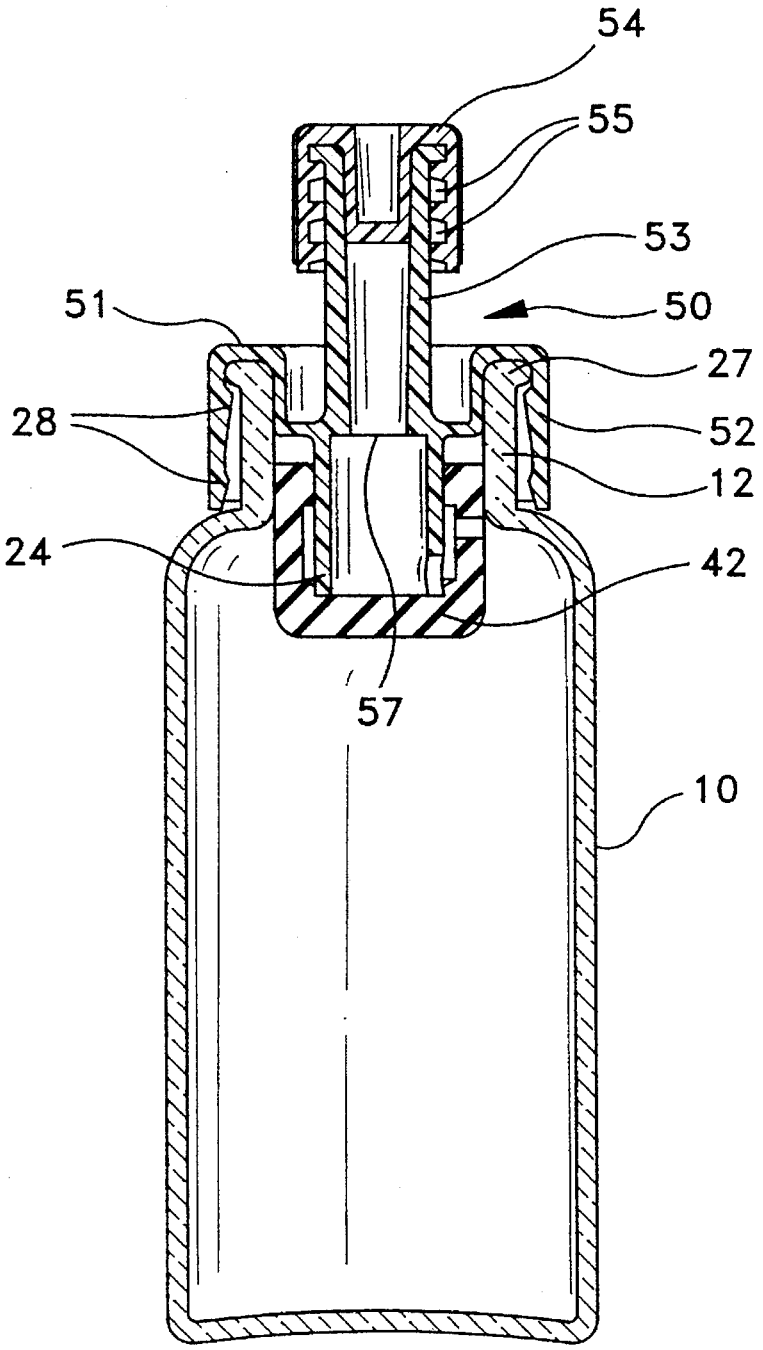
FIG. 10 represents another embodiment of a bottle according to the invention.

FIG. 10 shows a variation of the connection device described above. This connection device 50 is associated with a stopper means 42 identical to that shown in FIGS. 6 through 9 in association with the bottle which contains a powder. It will be noted, however, that connection device 50 may also be associated with a stopper means 16 such as that shown in FIGS. 2 through 5 in association with a bottle containing a lyophilisate. Said connection means comprises a capsule 51 with a small flange 52 passing above rim 27 of neck 12 of bottle 10. This flange, which is shown in the usage position, comprises, as before, interior projections 28 designed to cooperate with rim 27 to define the storage and usage positions. Said capsule has a cylindrical tip 24 (identical to that defined in FIG. 4) engaged inside stopper means 42 and a connecting tip 53 which is a conical locking female tip currently called a "Luer Lock". This tip is closed by a cover 54 with a threaded interior which screws onto connecting tip 53. In the example shown, a filter 57 is disposed inside the axial canal for passage of the liquid. This filter may be mounted in all the capsules of the embodiments shown in the preceding drawings. Note that this filter is preferably a membrane type filter.

For use, the connection with the Luer type tip or male Luer Lock is made after cap 54 is unscrewed.

As the medication is prepared at the pharmacy, it is necessary to have a reliable and irreversible method of connecting the bottle described with the transfusion pouch containing the appropriate solvent.

Many kinds of standard pouches containing a great variety of solvents or infusion solutions exist. An error in solvent selection may cause precipitation of the medication, alteration of its qualities, etc.

Therefore, only a competent, authorized person may decide on the choice of solvent. This choice is generally made by the pharmacist and not the medical personnel.

The connection system must fulfill the following requirements:

1) it must allow the pouch and the bottle to be connected without activating the system;
2) it must allow both devices to be returned to the store if treatment has not taken place (in case of death, interruption of treatment);
3) it must ensure identification of the medication in the pouch after reconstitution;
   a) in a clear fashion for the medical personnel;
   b) in code for the patient, for other patients and for visitors (cancer or stroke treatment, etc.).

Figure 11:
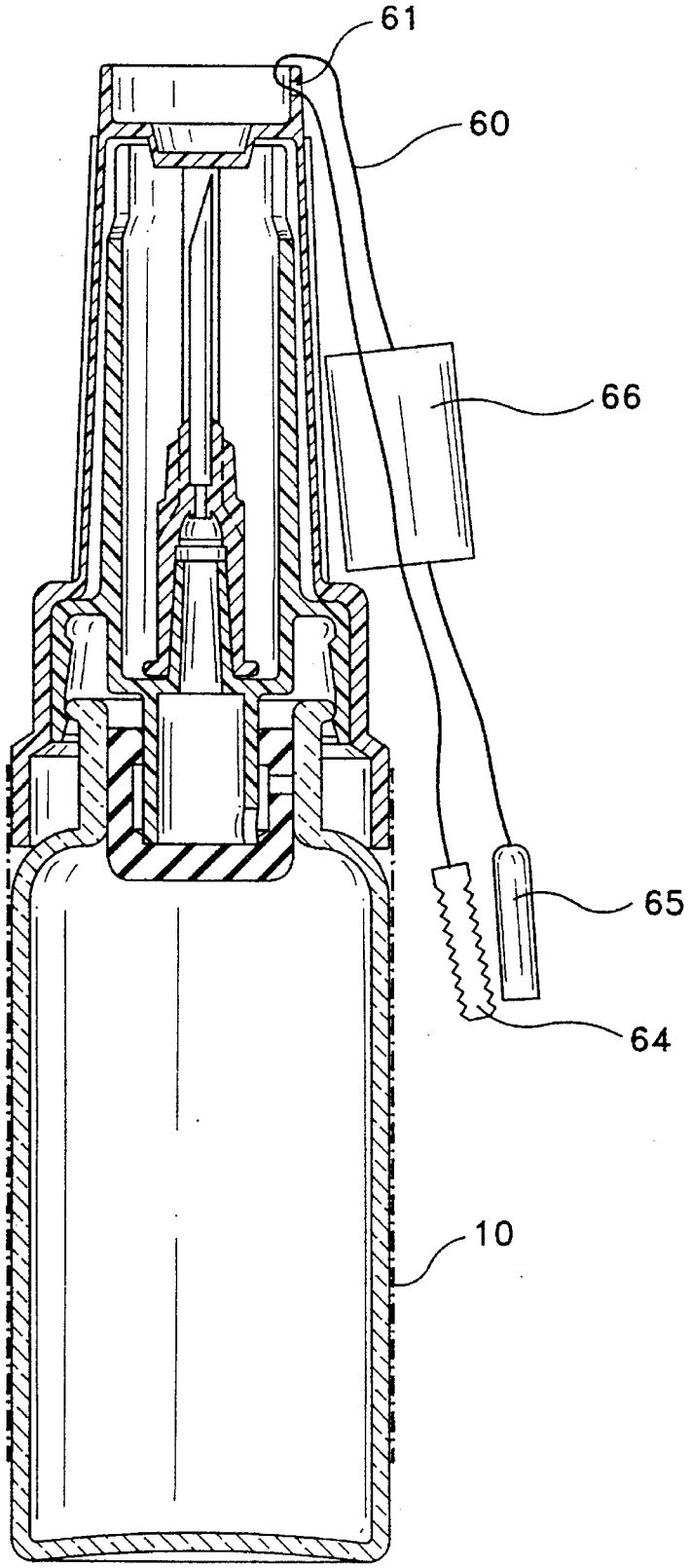
FIGS. 11 and 12 illustrate a specialized use of the bottle according to the invention.
Figure 12:
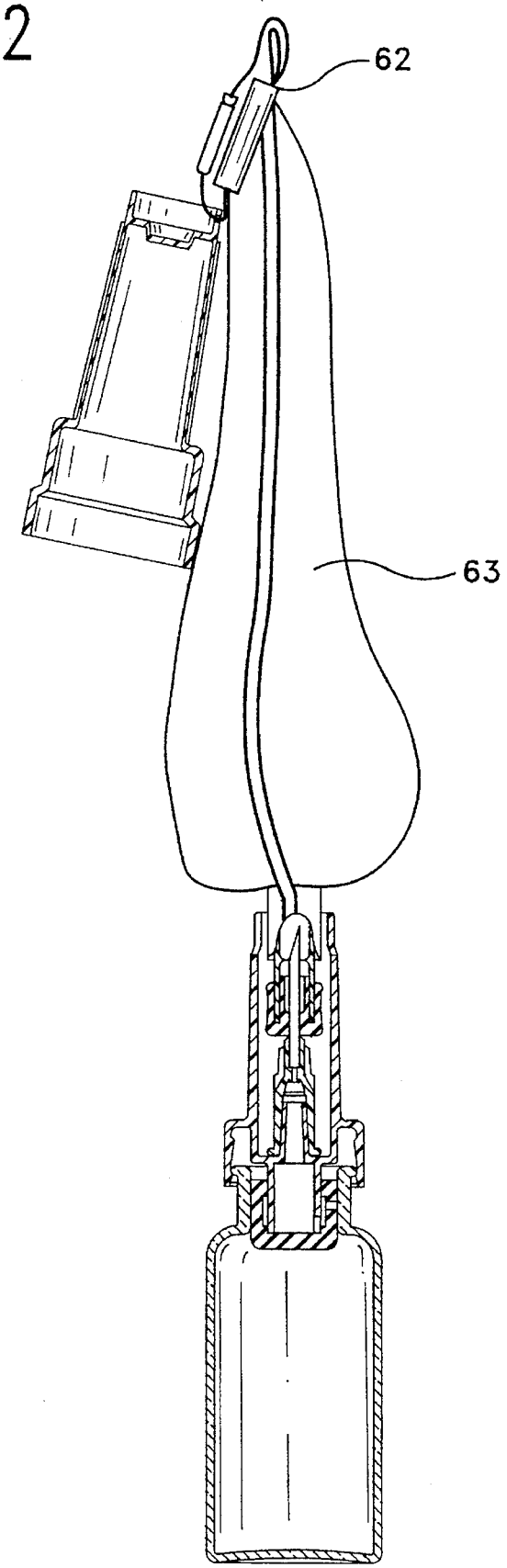

To achieve this, the cap of bottle 10 shown in FIGS. 11 and 12 has a passage 61 for a lace 60. Thus, the pharmacist may pass a lace 60 through passage 61 disposed on the head of the protective cap on the bottle, then pass this lace through one of the passages 62 disposed in the transfusion pouch 63 (for example, through the passage provided for hanging the pouch), and then permanently connect ends 64 and 65 of the lace. Laces such as this, made of synthetic material with permanent attachment devices, are available commercially. A specialized "lace" with a small plate 66 for recording inscriptions such as patient name, bed number, date and other information may be provided with the bottle package.

During preparation, medical personnel will be able to conduct complete verification of a medication. Thus, the protective cap will be removed from the bottle. The protective cap will remain connected to the pouch by the lace. The portion of the seal remaining attached to the cap will contain the "coded" information allowing medical personnel to identify the medication in the pouch.

The bottle with the needle is activated, then its contents dissolved and transferred to the pouch. The medical practitioner then pulls back the bottle and separates it from the pouch.

If the two devices are not used, they are returned to the pharmacy. The lace need only be cut and the product replaced in the store.

The bottle described above responds in every way to the requirements for storage and use of medicinal substances. It is hermetically sealed. It has a blocking system preventing activation during storage. It has a transfer device integral with the bottle itself which is stable and not subject to pressure or radial constraint. It guarantees sterility of the contents and storage area, including contents of the transfer device communicating with the inside of the bottle during use.

Furthermore, at the time of use, the connection established by virtue of the tamper-proof seal and the storage security system is severed by only one gesture. Activating the bottle and its transfer system is done simply, without effort, and without puncturing a stopper. Activation is irreversible and the apparatus absolutely cannot return to storage position. Activation is accomplished without any external devices, at the patient's side. Transfer takes place in a closed environment, with no outside contact. Joining the bottle to another receptacle is accomplished with standard, familiar devices.

A certain number of these attachment means are represented in the following drawings and described below.

Figure 13:
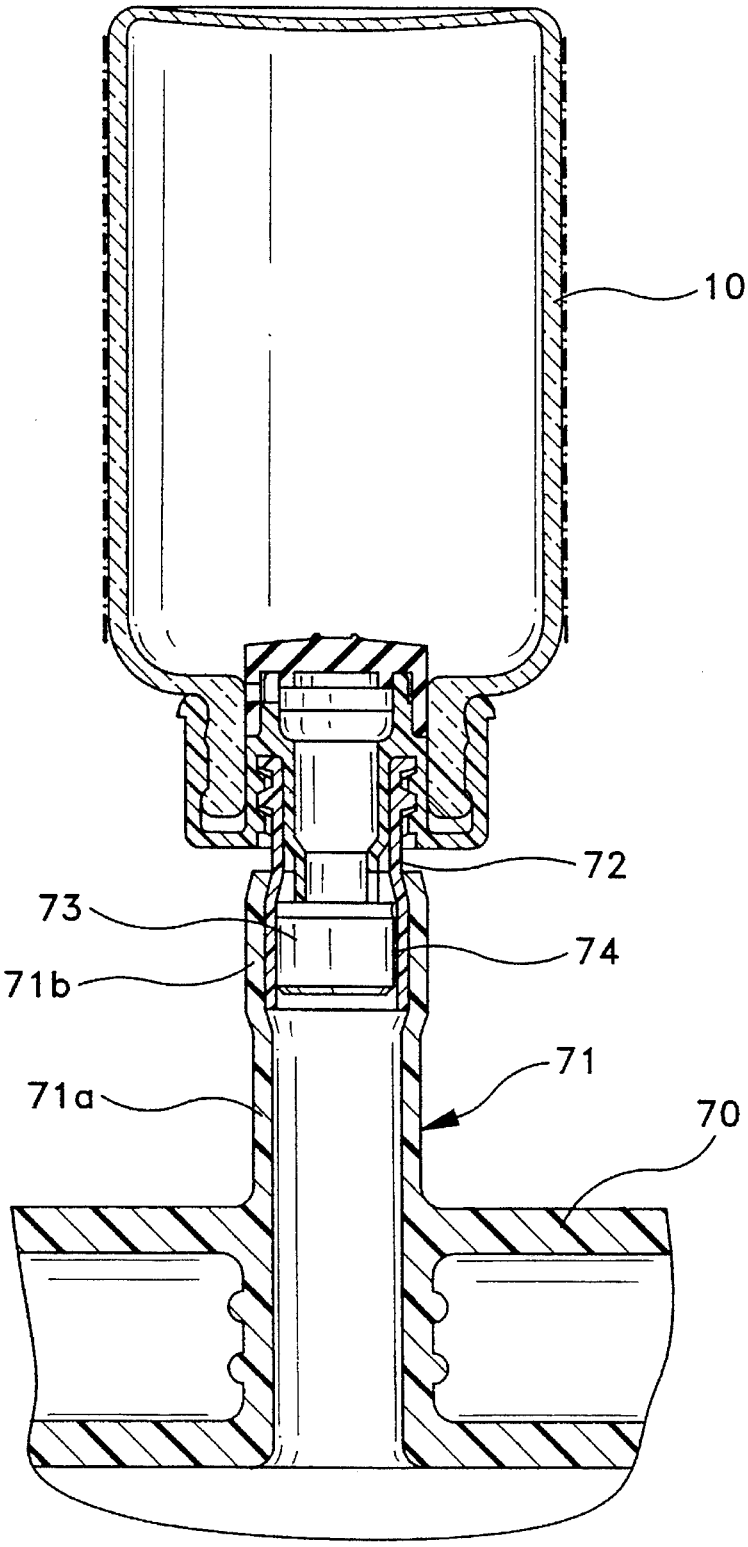
FIG. 13 represents a cross-section showing one way of attaching the bottle to a transfusion pouch.

FIG. 13 shows one way of attaching a bottle 10 with a transfusion pouch 70 having a connecting conduit 71 comprising a narrow portion 71*a* and a wide portion 71*b*. The bottle connecting device allows tip 72 to be screwed on. Connecting device 71 contains a stopper 73 which, when in narrow portion 71*a*, closes this conduit and when in wide portion 71*b*, forms a peripheral passage 74 between it and the conduit wall.

Figure 14:
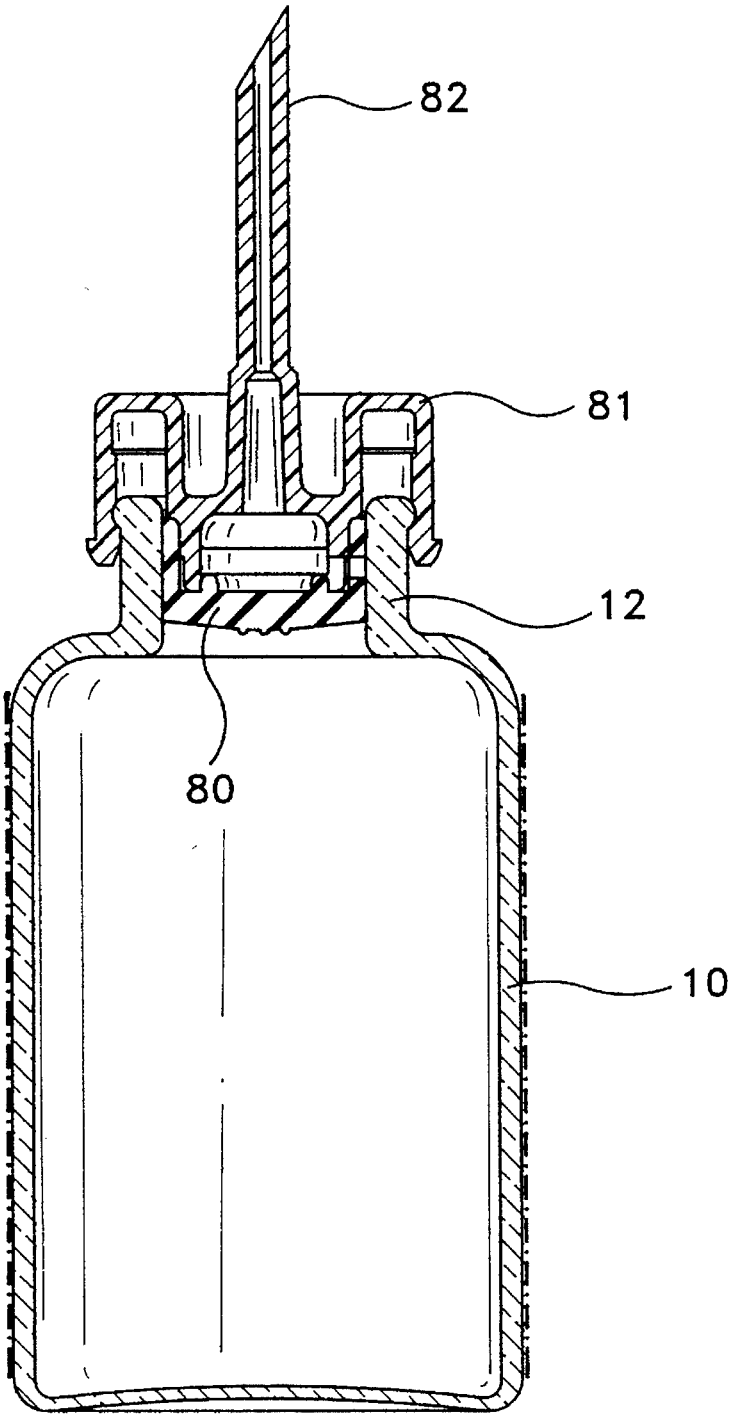
FIG. 14 illustrates a cross-section of a bottle having a capsule associated with a needle.

FIG. 14 shows a bottle 10 associated with a stopper device and a connection device comprising a stopper means 80, a capsule 81 and a needle 82, mounted to neck 12 of said bottle. In this embodiment needle 82 forms one piece with capsule 81.

Figure 15:
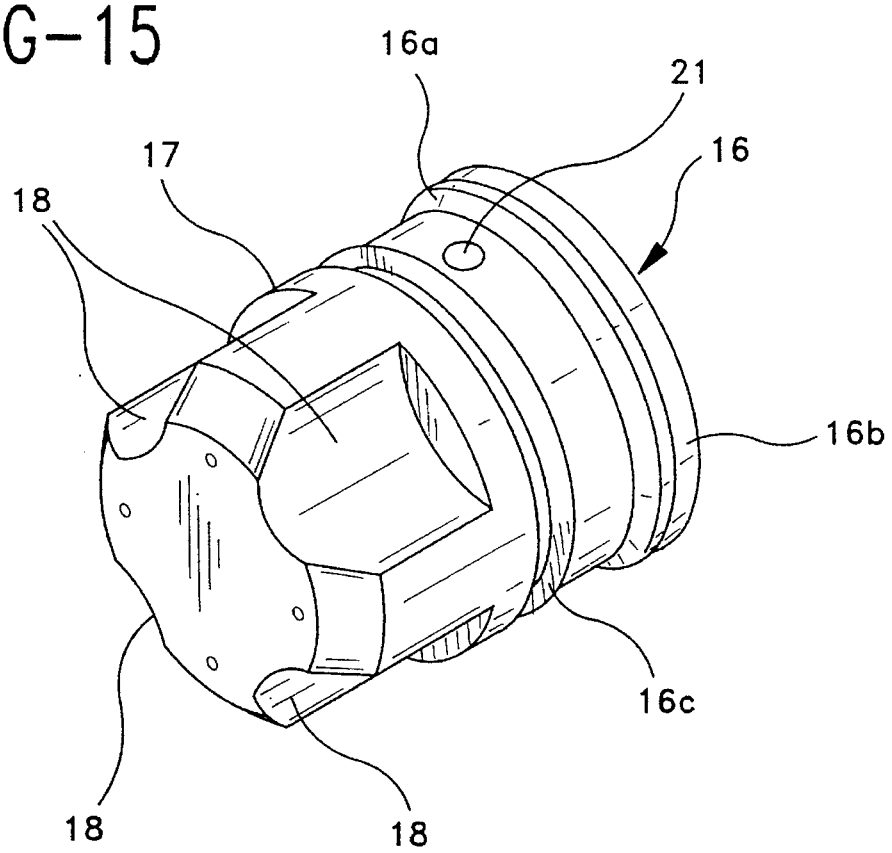
FIG. 15 represents a perspective of a stopper device designed for a lyophilization bottle.

FIG. 15 is a perspective of stopper means 16 which is shown in cross-section in FIG. 2. This stopper means comprises an upper portion 16*a* and a tip 17 which is an extension of the upper portion. Tip 17, when in the form of the embodiment shown, has four lateral openings 18 which intervene during the lyophilization phase. The upper portion 16*a* comprises a radial conduit 21 communicating with the outside through an essentially circular opening disposed in the central zone of said upper portion 16*a*, between two respective raised portions 16*b* and 16*c*.

Figure 16:
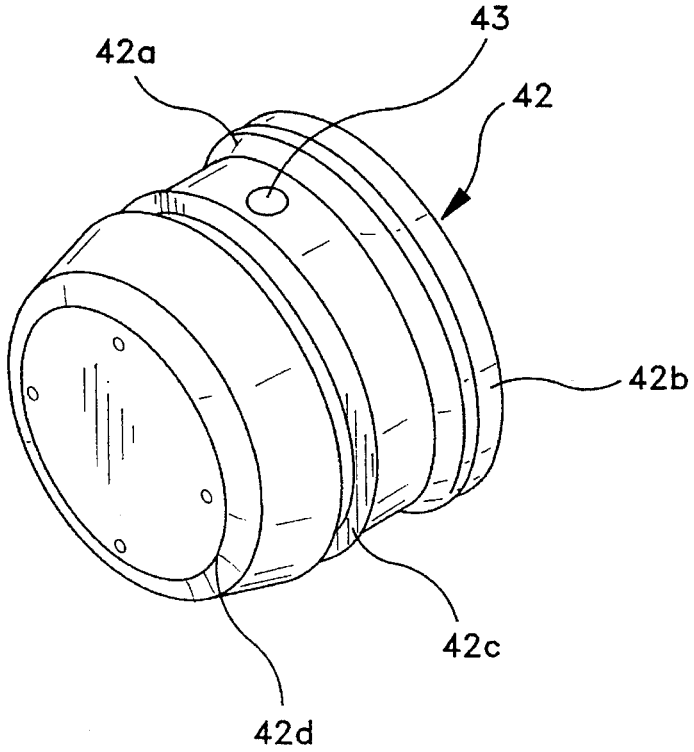
FIG. 16 represents a perspective of a stopper device of a bottle designed to hold a powdered substance.

FIG. 16 shows a stopper 42 used when bottle 10 is designed to hold a powder or liquid substance and not lyophilisate. This stopper means is shown in cross-section in FIG. 7. It comprises an upper portion 42*a* identical in all respects to the upper portion 16*a* of stopper means 16. More specifically, it comprises a radial canal 43 opening into a central zone defined by two raised portions 42*b* and 42*c*, respectively. A lower tip 42*d*, slightly truncated, extends the upper portion of the stopper. Note that this tip has no lateral opening.

Figure 17:
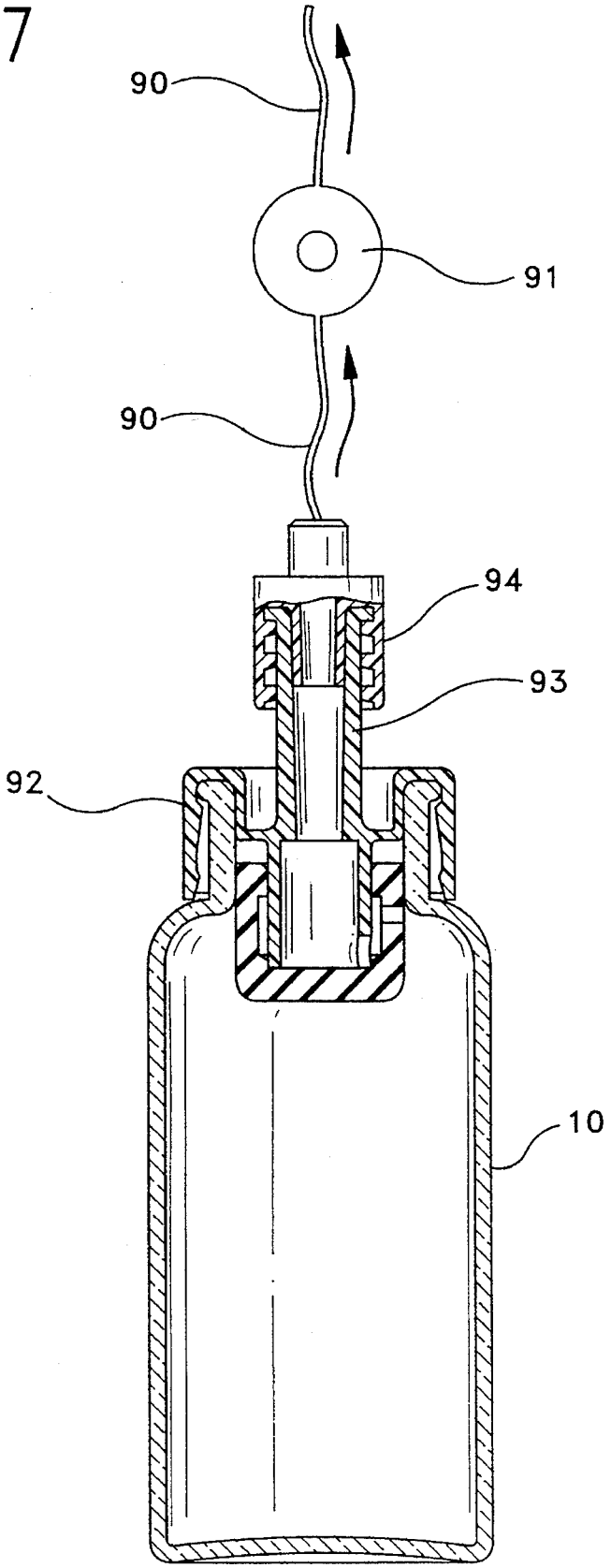
FIG. 17 represents a bottle according to the invention attached to a peristaltic pump.

FIG. 17 shows a particular use of bottle 10 connected by means of a flexible tube 90 to a peristaltic pump 91. In this embodiment, capsule 92 is provided with a connection tip 93 which is joined to a connection means 94 to achieve a Lust-Lock type coupling.

Figure 18:
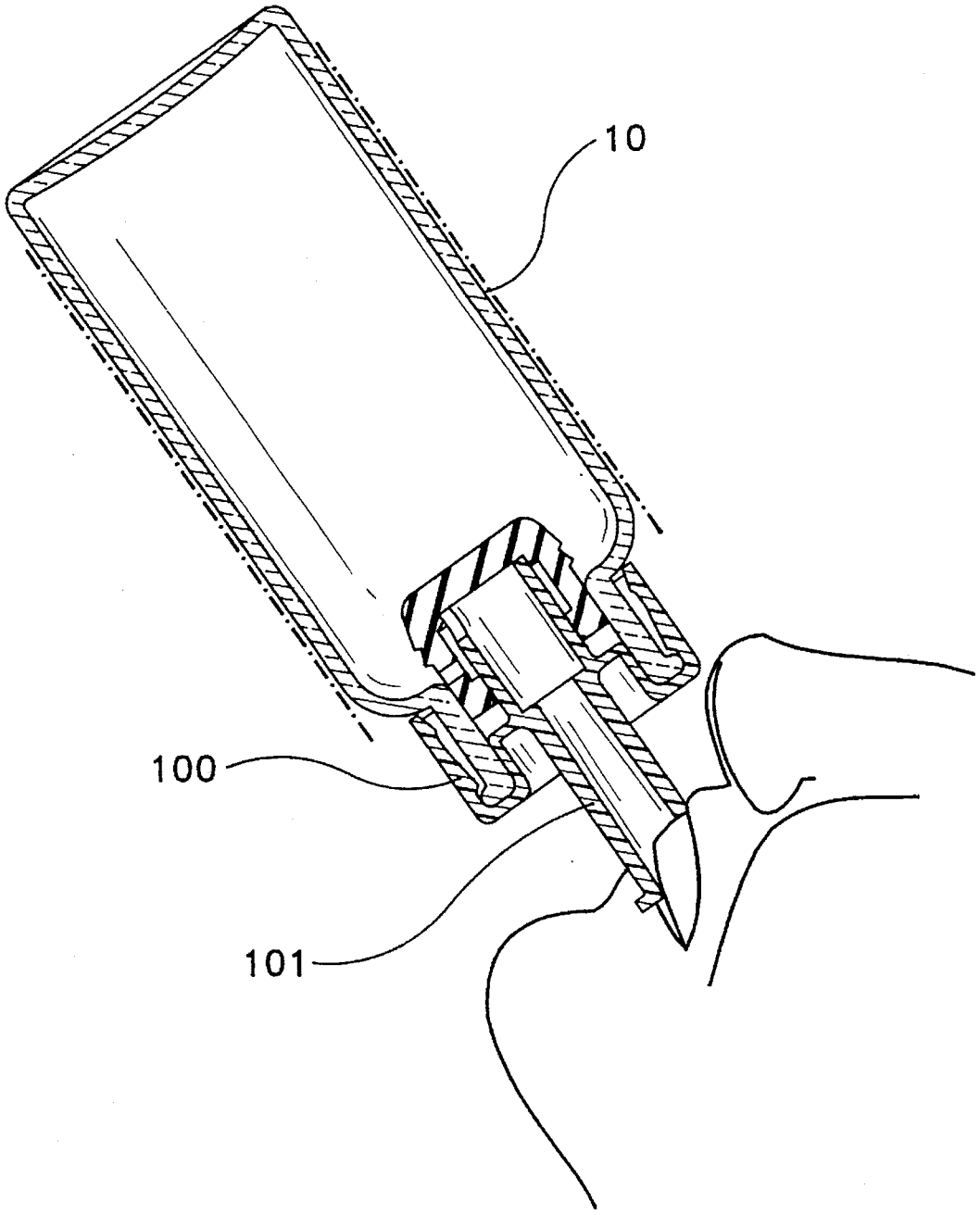
FIG. 18 represents a bottle provided with a buccal tip.

The embodiment shown in FIG. 18 corresponds to another application of the system. In this case, capsule 100 is provided with a tip 101 having no means for attachment to another apparatus, but which is designed to be placed in the patient's mouth. In this case, bottle 10 is designed to hold a medicinal substance to be absorbed through the cheeks.

Figure 19:
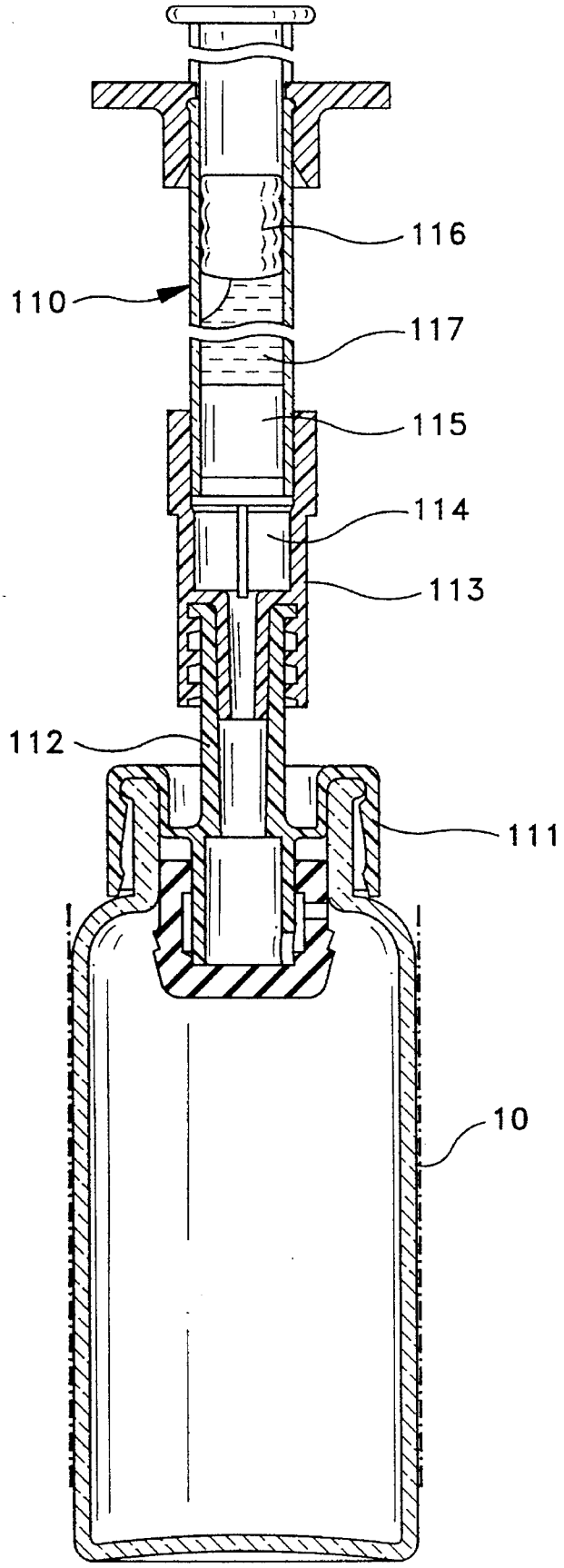
FIG. 19 represents a cross-section of a bottle according to the invention connected to a pre-filled syringe.

FIG. 19 shows another use for bottle 10, which in this case is coupled with a pre-filled syringe 110. Capsule 111 of the stopper device comprises a tip 112 identical to tip 93 shown in FIG. 17. The pre-filled syringe 110 is joined to tip 112 by a connection means 113 affixed to said tip by locking means of the Luer-Lock type. Connection means 113 comprises an interior cavity 114, the diameter of which is slightly greater than the diameter of stopper 115 sealing the end of syringe 110. After activating bottle 10, the operator plunges piston 116 of syringe 110 toward bottle 10, the effect of which is to push stopper 115 down into cavity 114. The liquid 117 which was initially stored between stopper 115 and piston 116 flows toward the inside of the bottle. After the desired mixture is obtained, the liquid may be recaptured in the syringe for subsequent use. Since the syringe is directly connected to the bottle by means other than the needle to be used for injection, no needle contamination takes place during this transfer phase.

Figure 20:
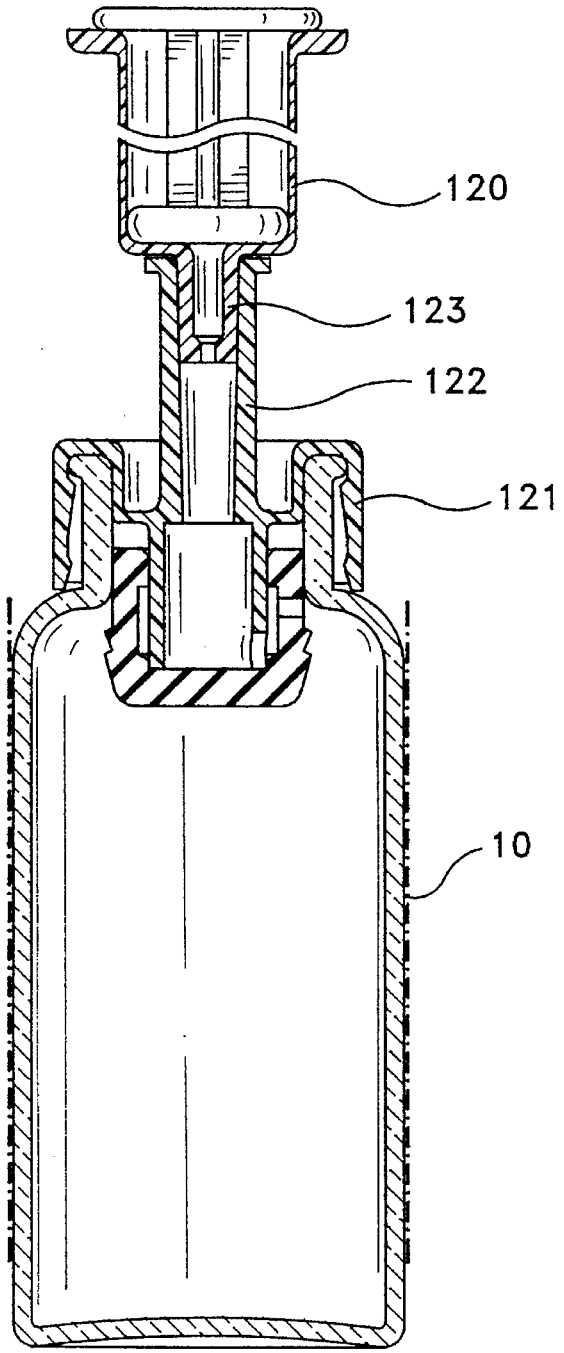
FIG. 20 represents a cross-section of a bottle attached to a traditional syringe.

FIG. 20 shows the connection of bottle 10 with a conventional syringe 120 which may be empty or pro-filled. The connection of these two components is a Lust-type connection. To achieve this, capsule 121 of the stopper device comprises a conical female tip 122 designed to engage with a truncated tip 123 which is actually the needle-holding tip of syringe 120. Here again, connection is effected by means other than by the needle for injecting the substance into the patient, so that the needle is not contaminated during the phase of transferring the substances for injection.

Figure 21:
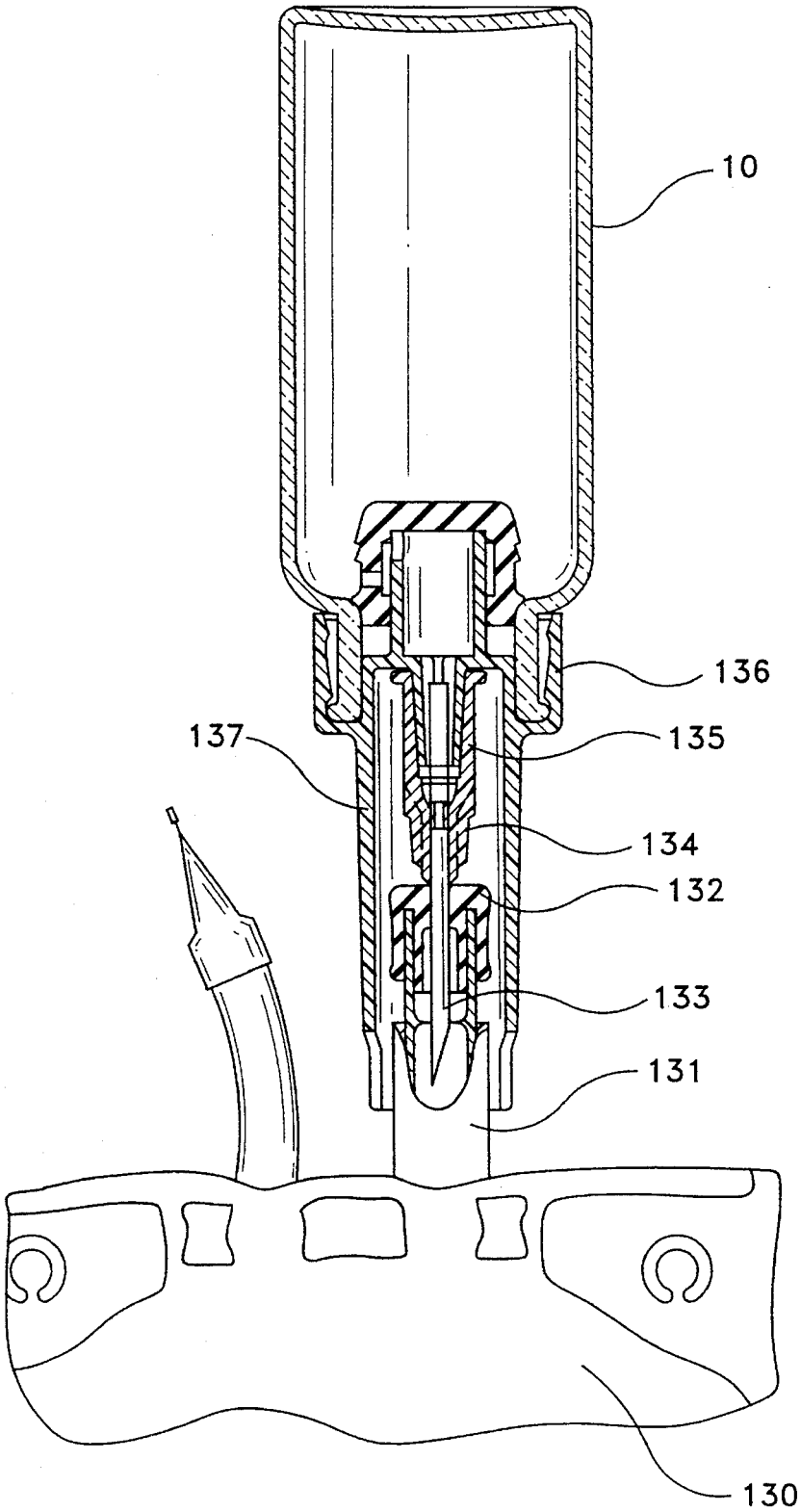
FIG. 21 represents a cross-section of a bottle equipped with a needle and connected to a transfusion pouch.

FIG. 21 shows another embodiment of the bottle as well as another way of using the bottle. Bottle 10 is attached to a transfusion pouch 130 comprising a connecting tube 131 closed by cap 132 made of flexible elastomeric material. The bottle is equipped with a transfer device comprising a needle 133 mounted on a needle support 134 adapted to tip 135 integral with capsule 136. All these elements are protected by a tubular element 137, essentially cylindrical, integral with capsule 136. After activation of bottle 10, the liquid substance inside transfusion pouch 130 can be transferred into said bottle, then the mixture obtained transposed into pouch 130.

Figure 22:
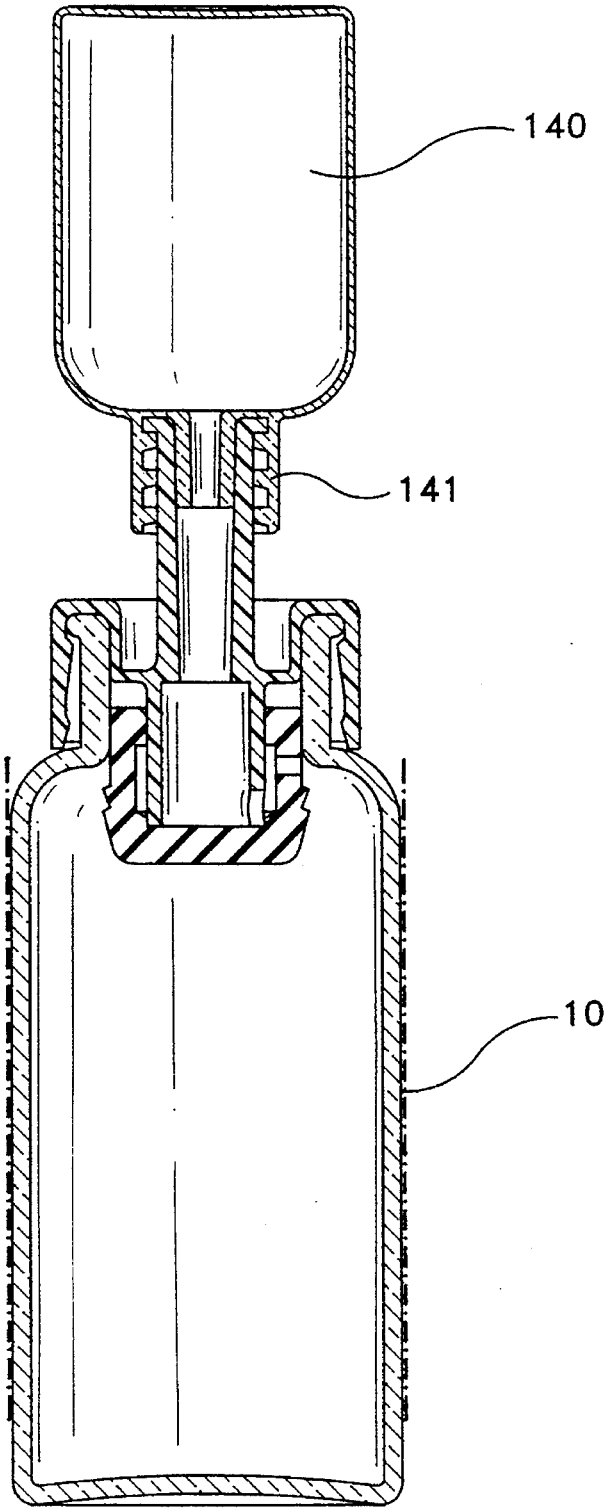
FIG. 22 represents a cross-section of a bottle according to the invention connected to a flexible bottle.

FIG. 22 shows another embodiment of bottle 10 which, in this case, is attached to a flexible bottle 140 by means of a Luer-Lock type device 141.

Figure 23:
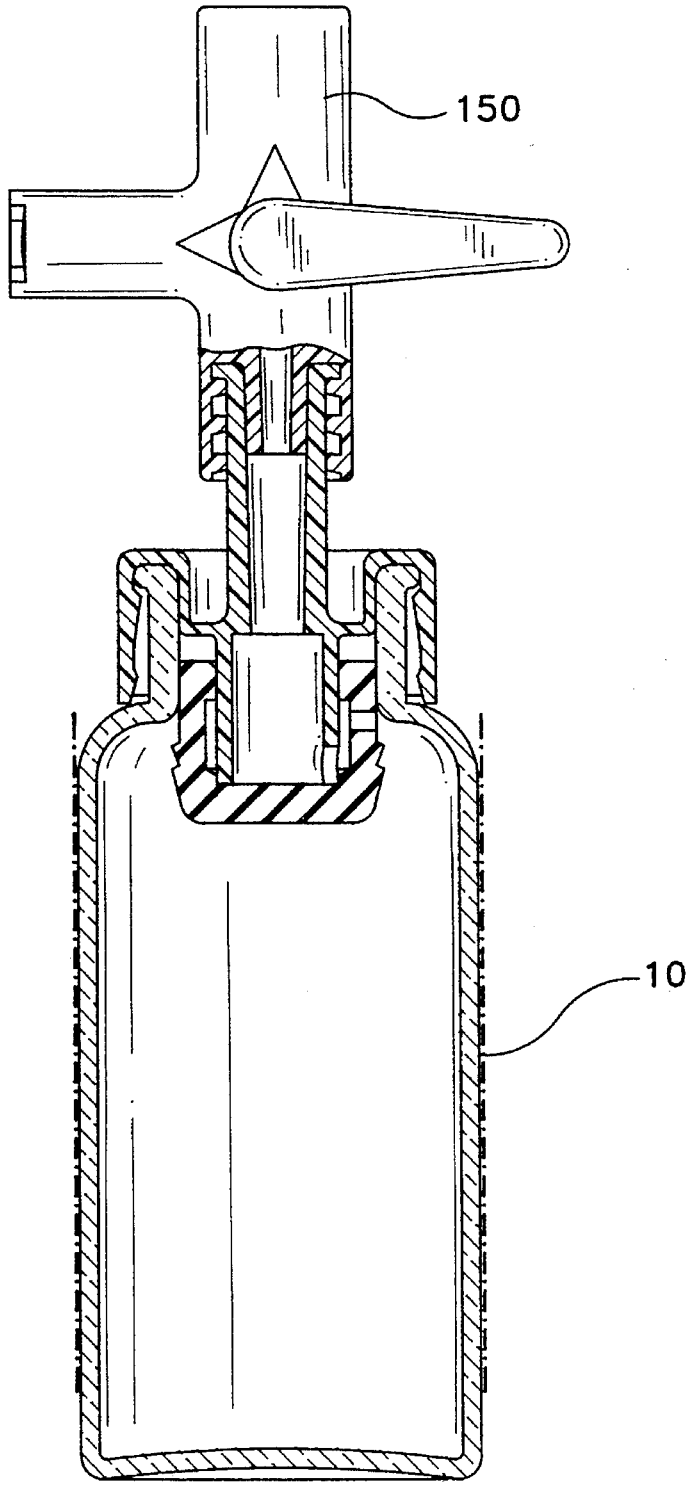
FIG. 23 represents a cross-section of a bottle according to the invention connected to a valve with three outlets.

FIG. 23 shows a variation of the embodiment shown in FIG. 22. In this case, flexible bottle 140 is replaced by a valve with three outlets 150.

Figure 24:
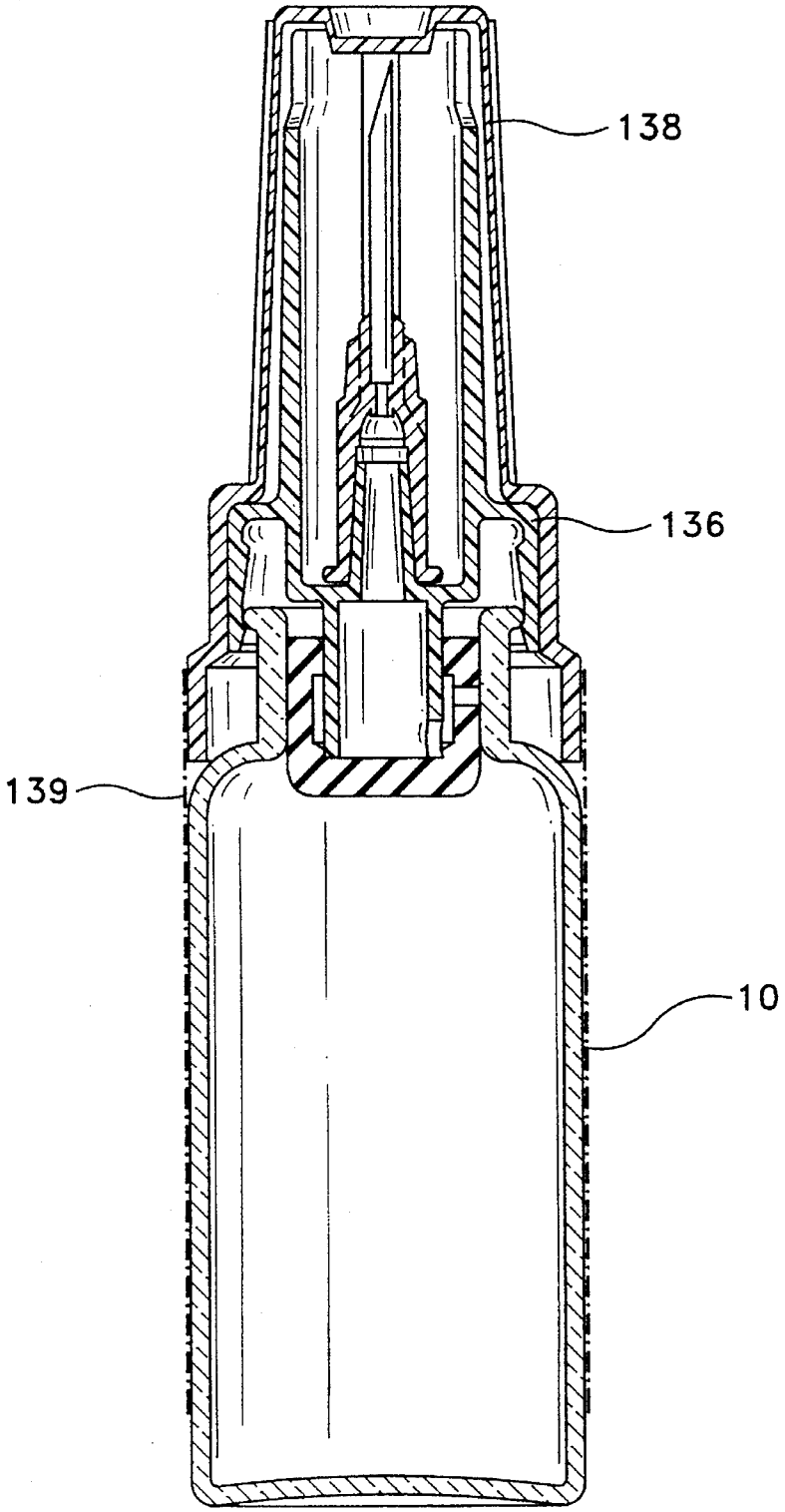
FIG. 24 represents a cross-section illustrating the storage position of a bottle according to the invention equipped with a needle.

FIG. 24 shows a bottle 10 corresponding to the use illustrated in FIG. 21 in the storage position. In this position, capsule 136 is surrounded by protective cap 138 and connected to the bottle by a tamper-proof seal 139.

Figure 25:
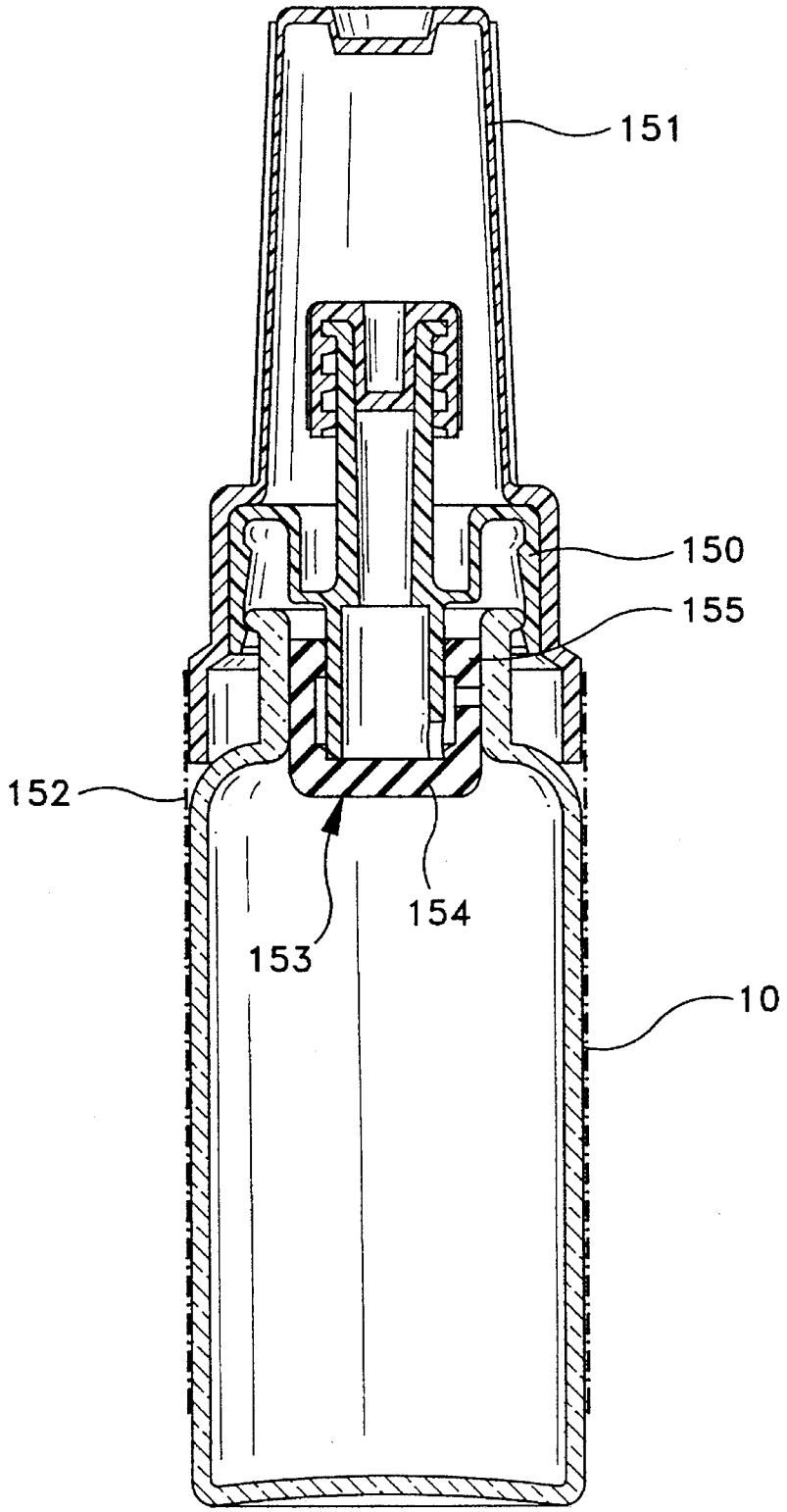
FIG. 25 represents a cross-section of a bottle according to the invention provided with a connection device of the Luer-Lock type and protected by a hooded cap.

FIG. 25 shows bottle 10, illustrated in detail in FIG. 22 and FIG. 23, in storage position. As before, capsule 150 is completely covered by a protective cap 151 joined to the bottle by a tamper-proof seal 152.

It will be noted that stopper means 153 engaged in the neck of bottle 10 is made of two parts, one part, head 154, being in contact with the substance in the bottle, and an annular gasket 155 which will only be in contact with the medicinal substance or the solution obtained after mixture with another substance during a short time span. Because of this, the two portions may be made of different materials; the head, of course, being made of a material compatible with the substance in the bottle. This manufacturing principle is applicable to all the bottles.

Figure 26:
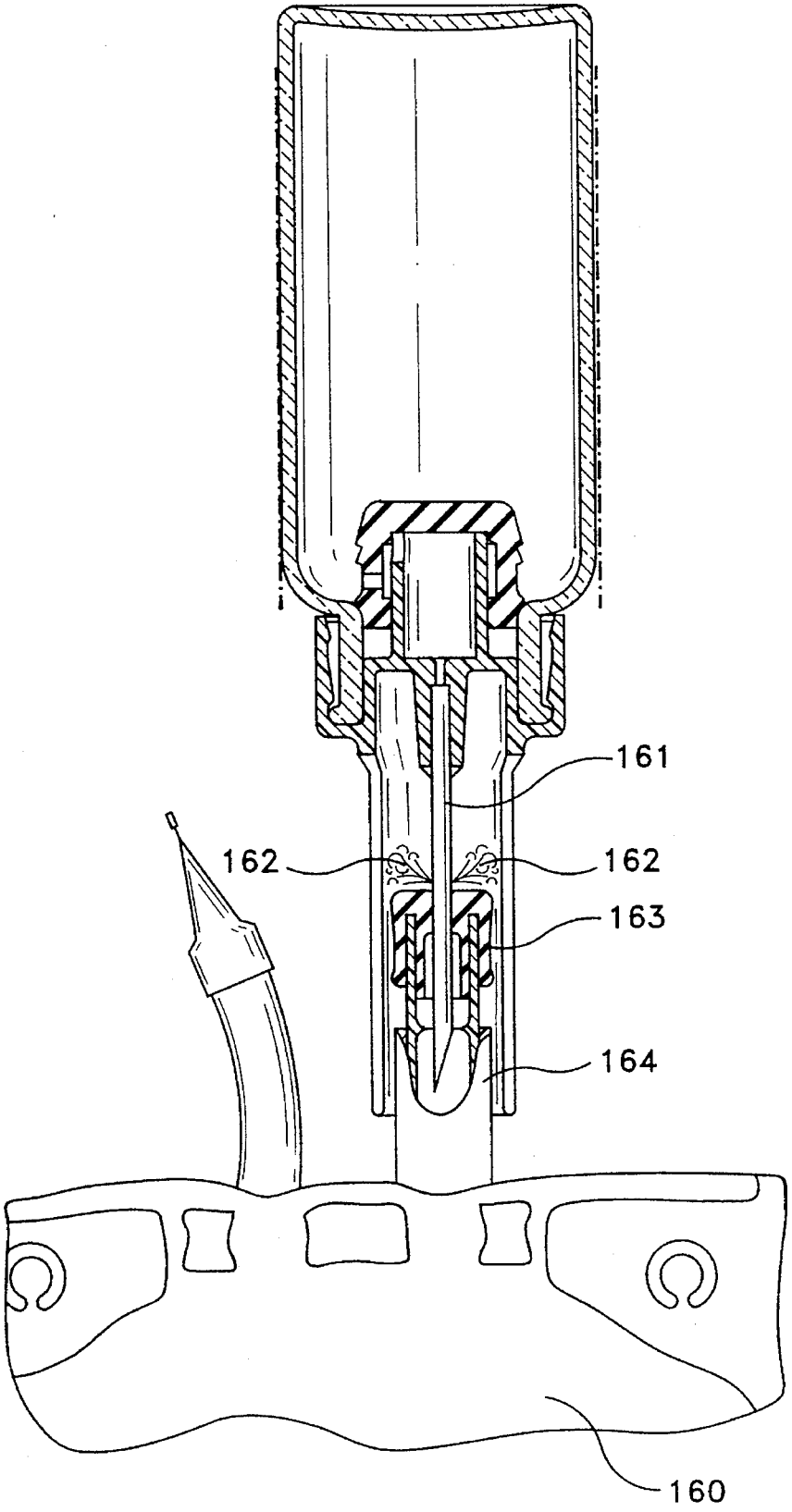
FIG. 26 represents a particular embodiment of a bottle designed for connection to a transfusion pouch.

FIG. 26 shows another embodiment especially adapted for the medicinal substances containing bicarbonate and/or citric acid or other chemical substances which emit considerable amounts of anhydrous carbonic substances upon dissolving. During the transfer of solvent contained in transfusion pouch 160, pressure inside the entire system increases considerably. Since anhydrous carbon gas dissolves rapidly in solution, it would be possible to wait several minutes before proceeding to transfusion; therefore, it is particularly advantageous if this gas can be simply and effectively removed. The means for achieving this comprises at least one lateral opening disposed in needle 161. In the embodiment shown, the needle has two openings 162 which are closed when it is plunged far enough inside stopper 163 sealing conduit 164 of the transfusion pouch 160, and which are disengaged, as shown in the drawing, when it is slightly retracted from said stopper.

Figure 27:
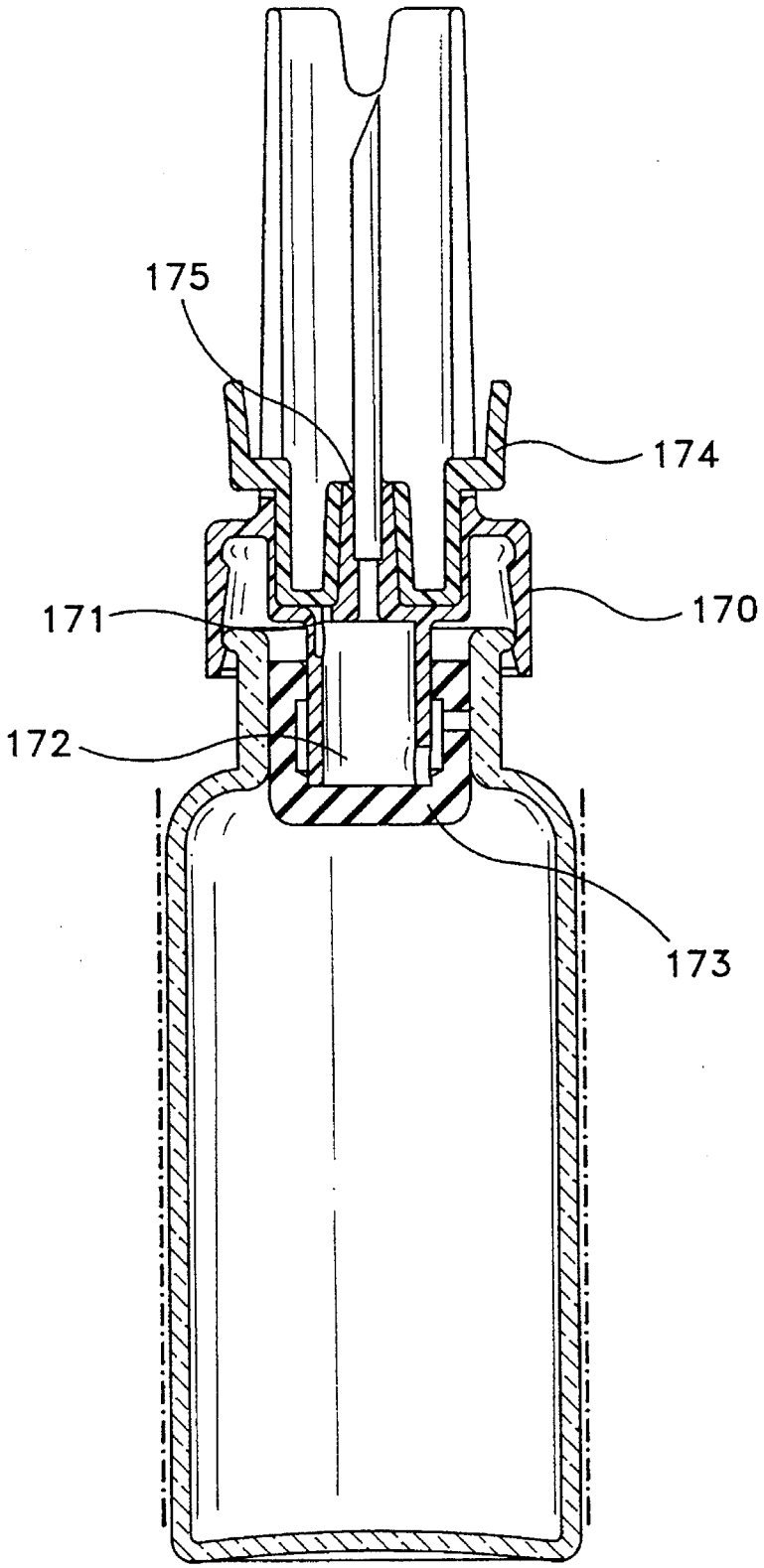
FIG. 27 represents a cross-section of another embodiment allowing pressure inside the bottle and/or the pouch to be evacuated.
Figure 28:
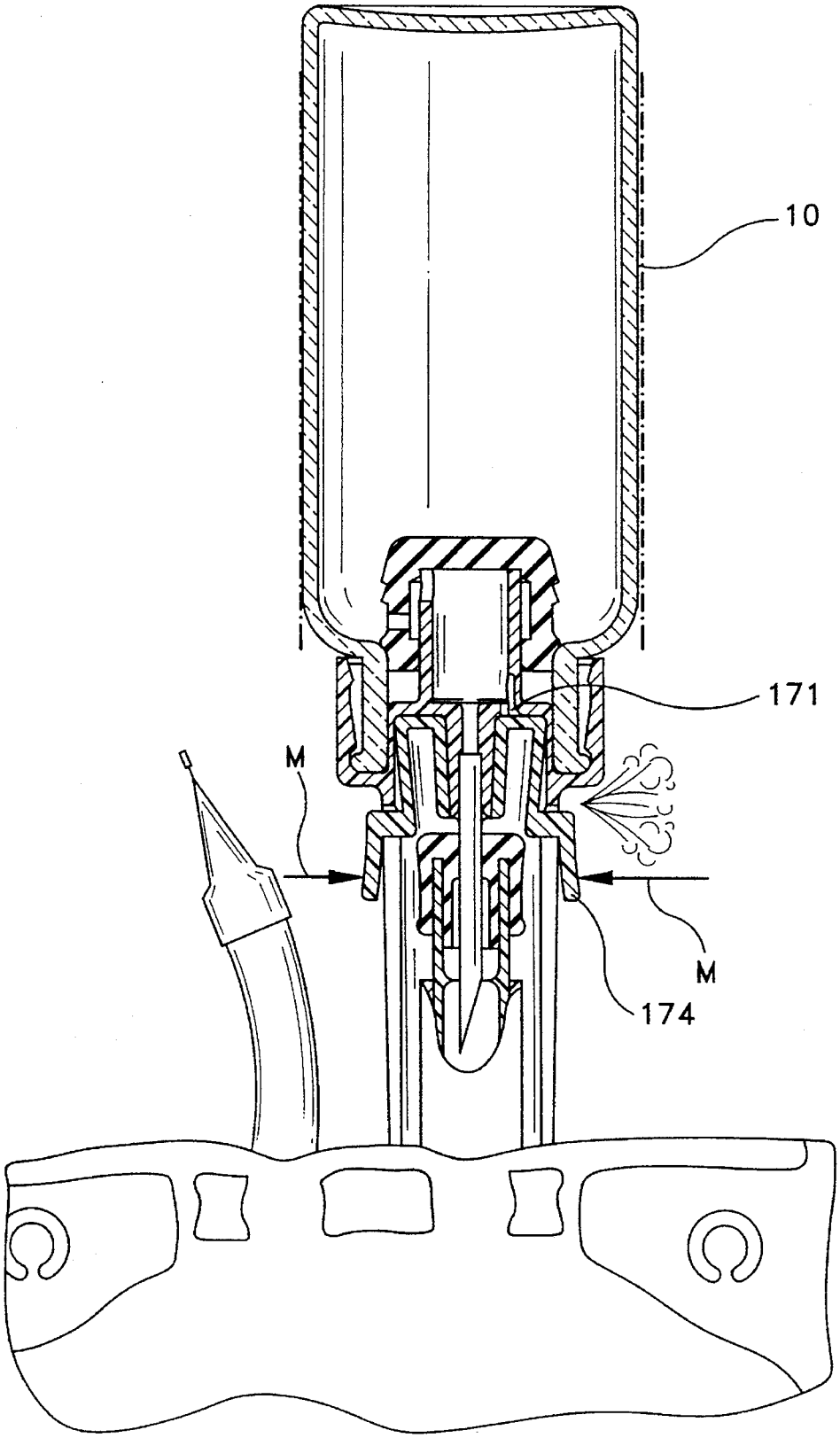
FIG. 28 represents a cross-section illustrating the bottle of FIG. 27 in the usage phase.

FIGS. 27 and 28 show another embodiment of a bottle equipped with a transfer device allowing rapid evacuation of the anhydrous carbon gas emitted when a medicinal substance or powder initially placed in the bottle is reconstituted with a solvent.

FIG. 27 shows an intermediate position between the storage and activated positions of the bottle and FIG. 28 shows the activated position of the bottle. Between the storage and intermediate positions shown in FIG. 27, a protective cap integrally covering the capsule has been withdrawn. In this embodiment, the capsule has an opening for communication between the inside and the outside of the system. To achieve this, capsule 170 has an opening 171 allowing communication between cavity 172 disposed inside stopper means 173 and the outside. A complementary element 174 on needle-holding tip 175 ensures momentary sealing of opening 171.

FIG. 28 shows the device in use. When the operator presses upon the branching flanges of element 174 as shown by arrows M, he frees opening 171 and allows the pressurized gas inside the pouch and the bottle to escape. This embodiment allows release of pressure resulting from anhydrous carbon which builds up during preparation of an antibiotic solution. A mere push exerted on the flexible branches of element 174 by, for example, the thumb and index finger, achieves the desired result.

Figure 29:
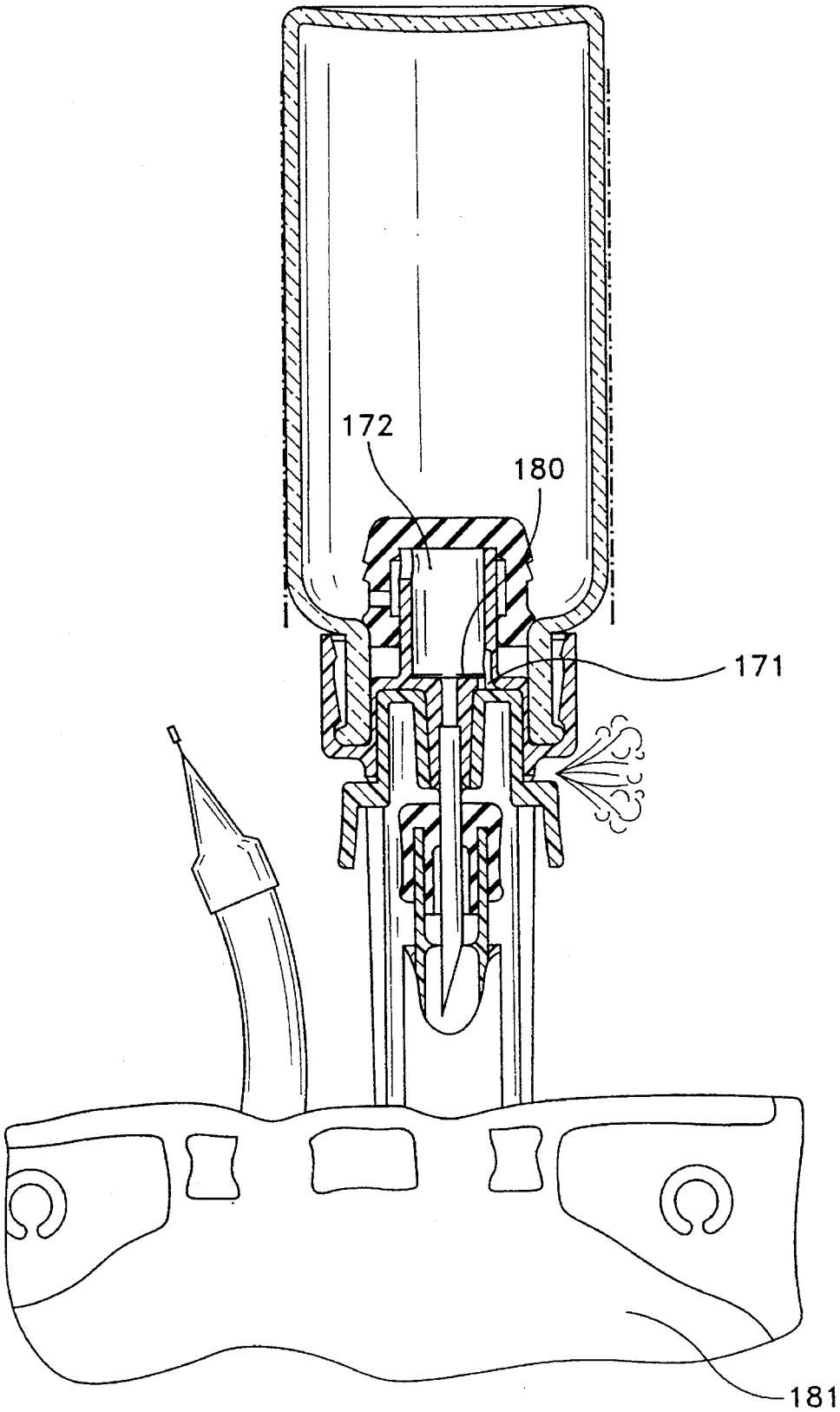
FIG. 29 represents a variation of the embodiment of FIGS. 27 and 28.

FIG. 29 shows a variation of the device of FIG. 28. The modification consists of inserting a hydroponic filter 180 inside cavity 172, said filter being perforated in the center so that liquids may pass directly between the bottle and pouch 181, but also being positioned so that it covers vent opening 171. The role of the filter is to minimize the risk of releasing antibiotic or antimitotic aerosols, which are very noxious to the user.

Figure 30:
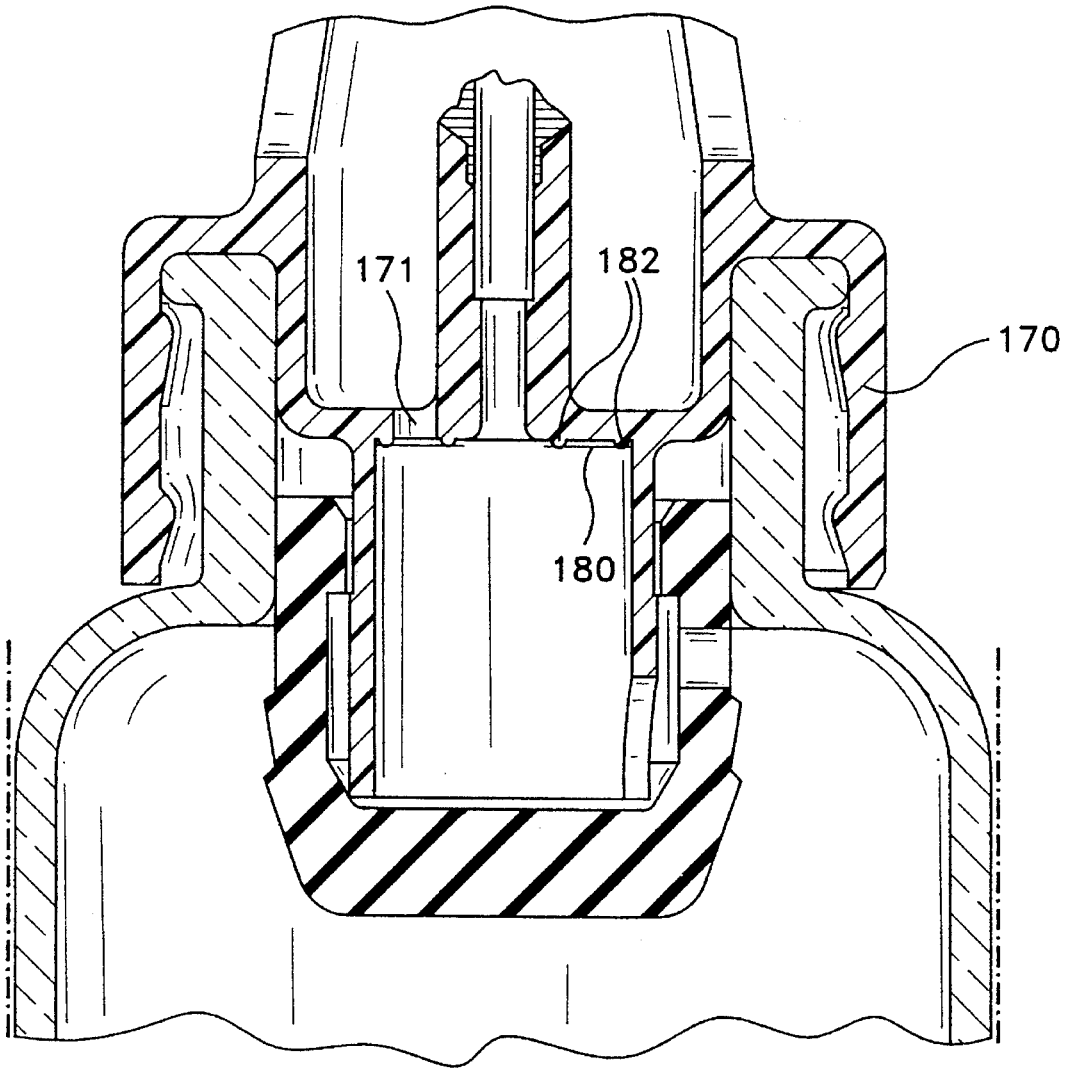
FIG. 30 represents an enlarged cross-section with a more specific rendering of the hydroponic filter mounted inside the stopper means.

FIG. 30 is an enlargement of the area supporting filter 180. Vent 171 comprises an axial perforation disposed in the wall of capsule 170. Filter 180 comprises an annular portion in contact with two annular rims 182 disposed on the wall of the capsule comprising opening 171. This opening, which is unique in the form of embodiment shown, could be replaced by several openings disposed in the annular zone defined by the two rims 182.

The advantage of having the hydroponic filter is that pressure can be released at any moment without risking the release of aerosols which, as mentioned previously, are particularly noxious to the user.

I claim:

1. A single compartment storage and transfer bottle designed for storing a medicinal substance and for transferring the medicinal substance, said bottle including a hollow body opened at one end and forming a restricted open neck, a capsule slidably mounted to said neck, a stopper device being engagable within said restricted open neck and supported by said capsule, said bottle being sterilizable and being designed to resist thermal strains of lyophilization, said stopper device having an internal cavity and at least one radial canal communicating with said internal cavity, a transfer device mounted to said capsule and communicating with the internal cavity of said stopper device, said stopper device being displacable between a storage position in which said stopper device constitutes an impermeable seal with said restricted open neck and said radial canal is closed by an inner surface of said restricted open neck, and a utility position in which said radial canal communicates with an interior of said bottle to form an opening for allowing evacuation of said medicinal substance from said bottle through said radial canal and said internal cavity, a cap covering at least a portion of said capsule, and an annular seal extending between said cap and bottle body, said seal holding said cap on said bottle body.

2. A bottle according to claim 1, wherein said stopper device is mounted on a capsule secured to the neck of said bottle and said capsule facilitates axial movement of said stopper device between said storage position and said utility position.

3. A bottle according to claim 1, wherein said capsule is provided with a conical connecting tip and with a tightening element engaged with said stopper device and communicating with said internal cavity.

4. A bottle according to claim 3, including a needle assembly mounted to said conical connecting tip, said capsule including an essentially cylindrical protective element which has a length at least approximately as long as a length of the needle.

5. A bottle according to claim 1, including means for flexibly connecting said bottle to another container.

6. A bottle according to claim 5, wherein said connection means comprise an elongate lace member secured to said cap.

7. A bottle according to claim 1, wherein the transfer device includes a needle assembly mounted to said capsule.

8. A bottle according to claim 7, wherein said needle assembly comprises at least one lateral opening disposed to allow evacuation of pressure fluid generated, during use, within said bottle.

9. A bottle according to claim 1, wherein said stopper device further comprises a vent and a flexible stopper element disposed, in a first position, to block said vent and, in a second position, to located to open said vent.

10. A bottle according to claim 9, wherein said vent is disposed in a wall of said capsule.

11. A bottle according to claim 1, wherein said stopper device comprises a head portion and a separate annular gasket portion.

12. A bottle according to claim 11, wherein the head portion and the annular gasket portion are made from different materials.

13. A bottle according to claim 1, wherein a tip portion of said stopper device, remote from said radial canal, is provided with at least one lateral opening to allow escape of fluid generated during lyophilization when said stopper device is partially inserted into and engaged within said restricted open neck.

14. A bottle according to claim 1, wherein said bottle is made of glass.

15. A mixing device comprising:

a bottle having a neck portion;

a capsule slidably mounted to the neck portion of the bottle, the capsule including a hollow body defining a conduit having a bottom opening within the bottle and top opening outside of the bottle, the outer surface of the hollow body and the inner surface of the neck portion of the bottle defining an annular passage;

an annular gasket mounted within the annular passage between the hollow body and the bottle;

a stopper mounted to a bottom end of the hollow body and covering the bottom opening and the annular space when the hollow body and stopper are in a storage position, and a radial notch defined within the bottom portion of said hollow body, said radial notch providing fluid communication between said bottle and said conduit when said closure is positioned beneath said neck portion.

16. A mixing device as described in claim 15, wherein said annular gasket is made from a different material than said stopper.

17. A mixing device as described in claim 15, including a cap mounted to said capsule and a seal connecting said cap to said bottle.

18. A mixing device comprising:

a bottle having a neck portion;

a hollow capsule slidably mounted to the neck portion of the bottle, said capsule having a first end portion and a second end portion;

a stopper assembly mounted to the first end portion of the capsule, said stopper assembly including an internal cavity and a radial canal communicating with said internal cavity, and a needle having a length mounted to the second end portion of the capsule, said needle including a bore therethrough, an end opening communicating with said bore, and a lateral opening along said length communicating with said bore.

19. A mixing device comprising:

a bottle having a neck portion;

a hollow capsule slidably mounted to the neck portion of the bottle, said capsule having a first end portion, a second end portion, and a vent;

a stopper assembly mounted to the first end portion of the capsule, said stopper assembly including an internal cavity and a radial canal communicating with said internal cavity, said vent in said capsule communicating said internal cavity and the exterior of said bottle;

valve means for selectively opening and closing said vent, and transfer means mounted to said capsule for connecting said bottle to a second vessel.

20. A mixing device as described in claim 19, including means for manually opening and closing said valve means.

21. A mixing device as described in claim 19, including filter means for filtering fluid passing from said internal cavity of said stopper through said vent.

* * * * *